US012740623B2

(12) United States Patent
Zhu

(10) Patent No.: US 12,740,623 B2
(45) Date of Patent: Sep. 22, 2026

(54) UMBRELLA ASSEMBLY HAVING A MODULARIZED DRIVE MODULE

(71) Applicant: MAXTON ENGINEERING LTD., Central (HK)

(72) Inventor: Shou Qiang Zhu, La Verne, CA (US)

(73) Assignee: MAXTON ENGINEERING LTD., Central (HK)

( * ) Notice: Subject to any disclaimer, the term of this patent is extended or adjusted under 35 U.S.C. 154(b) by 317 days.

(21) Appl. No.: 18/296,371

(22) Filed: Apr. 5, 2023

(65) Prior Publication Data

US 2023/0380557 A1 Nov. 30, 2023

Related U.S. Application Data

(60) Provisional application No. 63/327,794, filed on Apr. 5, 2022.

(51) Int. Cl.

*A45B 25/16* (2006.01)
*A45B 23/00* (2006.01)
*A45B 25/14* (2006.01)

(52) U.S. Cl.

CPC ..... *A45B 25/165* (2013.01); *A45B 23/00* (2013.01); *A45B 25/14* (2013.01); *A45B 2023/0012* (2013.01); *A45B 2200/1009* (2013.01); *A45B 2200/1018* (2013.01); *A45B 2200/1027* (2013.01)

(58) Field of Classification Search

CPC ..... A45B 25/165; A45B 2200/1009; A45B 2200/1018; A45B 2200/1027

See application file for complete search history.

(56) References Cited

U.S. PATENT DOCUMENTS 5,172,711 A * 12/1992 Mueller ..... A45B 3/00 135/20.3
5,899,663 A * 5/1999 Feder ..... F04D 29/34 416/5
6,612,713 B1 9/2003 Kuelbs
7,188,633 B2 3/2007 Zerillo
7,753,546 B2 7/2010 Kuelbs
8,061,374 B2 11/2011 Li (Continued)

FOREIGN PATENT DOCUMENTS

CN 203538560 U 4/2014
CN 104757757 A 7/2015

(Continued)

*Primary Examiner* — Robert Canfield
(74) *Attorney, Agent, or Firm* — LIU & LIU

(57) ABSTRACT

An umbrella assembly with a drive module assembly that comprises a plurality of modularized units, including a separate power supply unit and a separate drive unit. The modularized units are removably/detachably attached in a stacked structure of the overall drive module using quick connect couplings. The interfacing top and bottom sides of the adjacent modularized units are provided with complementary electrical connection terminals. The drive module is structurally and operatively coupled to the frame structure of the canopy of the umbrella assembly to operate to open/extend or close/collapse the canopy between an opened configuration and a closed configuration, by varying the distance between the upper hub and the lower hub of the frame structure.

19 Claims, 32 Drawing Sheets

(56) References Cited

U.S. PATENT DOCUMENTS

| | | | | |
|---|---|---|---|---|
| 8,069,868 | B2 * | 12/2011 | Kuelbs | F24F 5/0035 135/20.3 |
| 8,375,966 | B2 | 2/2013 | Kuelbs | |
| 8,727,555 | B2 | 5/2014 | Kuelbs | |
| 8,757,183 | B2 * | 6/2014 | Volin | A45B 25/143 135/25.4 |
| 8,794,781 | B2 | 8/2014 | Kuelbs | |
| 8,857,453 | B2 * | 10/2014 | Souma | A45B 25/143 135/20.3 |
| 9,951,541 | B1 * | 4/2018 | Gharabegian | A45B 23/00 |
| 10,499,715 | B2 | 12/2019 | Jin | |
| 10,538,937 | B2 | 1/2020 | Gharabegian | |
| 10,646,011 | B2 | 5/2020 | Wei et al. | |
| 10,820,672 | B2 | 11/2020 | Gharabegian | |
| 10,856,631 | B1 * | 12/2020 | Schulhofer | A45B 25/22 |
| 10,912,357 | B2 | 2/2021 | Gharabegian | |
| 11,910,891 | B2 * | 2/2024 | Mullet | A45B 25/10 |
| 2004/0040591 | A1 * | 3/2004 | Ma | A45B 25/143 135/98 |
| 2004/0084071 | A1 * | 5/2004 | Gray | A45B 3/00 135/16 |
| 2004/0149325 | A1 * | 8/2004 | Kuelbs | F24F 5/0035 135/20.3 |
| 2005/0072451 | A1 * | 4/2005 | Vivian | A45B 25/16 135/16 |
| 2006/0266398 | A1 * | 11/2006 | Wu | A45B 3/04 135/91 |
| 2006/0272686 | A1 * | 12/2006 | Tung | A45B 3/04 135/16 |
| 2007/0058360 | A1 * | 3/2007 | Li | A45B 3/04 362/102 |
| 2008/0023053 | A1 | 1/2008 | Chan | |
| 2008/0053496 | A1 * | 3/2008 | Li | A45B 3/02 135/21 |
| 2010/0024855 | A1 * | 2/2010 | Li | A45B 25/00 135/16 |
| 2010/0132751 | A1 * | 6/2010 | Li | A45B 23/00 135/96 |
| 2010/0192999 | A1 * | 8/2010 | Li | A45B 25/00 135/96 |
| 2010/0245032 | A1 * | 9/2010 | Li | A45B 23/00 340/3.1 |
| 2014/0111948 | A1 * | 4/2014 | Ma | A45B 3/04 361/729 |
| 2018/0187447 | A1 * | 7/2018 | Gharabegian | E04H 15/02 |
| 2018/0268056 | A1 * | 9/2018 | Gharabegian | G11B 27/34 |
| 2019/0242151 | A1 * | 8/2019 | Gharabegian | H02K 11/0094 |
| 2019/0281935 | A1 * | 9/2019 | Gharabegian | G05B 15/02 |
| 2019/0338837 | A1 | 11/2019 | Gharabegian | |
| 2020/0063459 | A1 | 2/2020 | Gharabegian | |
| 2020/0066266 | A1 * | 2/2020 | Gharabegian | H04R 1/028 |
| 2023/0301406 | A1 * | 9/2023 | Zhu | A45B 25/02 |

FOREIGN PATENT DOCUMENTS

| | | | |
|---|---|---|---|
| CN | 105795636 | A | 7/2016 |
| FR | 2799486 | A | 4/2001 |
| IT | 2019000014817 | A | 2/2021 |
| WO | 2010051756 | A | 5/2010 |

* cited by examiner

UMBRELLA ASSEMBLY HAVING A MODULARIZED DRIVE MODULE

This application claims the priorities of U.S. Provisional Patent Application No. 63/327,794 filed on Apr. 5, 2022. This application is fully incorporated by reference as if fully set forth herein. All publications noted below are fully incorporated by reference as if fully set forth herein.

FIELD OF THE INVENTION

The present invention is directed to an umbrella with a collapsible/retractable/foldable frame, and in particular to a centralized drive module for such an umbrella.

BACKGROUND OF THE INVENTION

Large collapsible umbrellas, such as patio umbrellas, may be in the form having a central support post or a side support post.

For a central supported umbrella, it includes a central support post having at its upper end a frame structure that supports a canopy made of a flexible material (e.g. fabric). Heretofore, that frame structure of umbrellas includes a network or array of radially disposed ribs, extending radially in a circle, configured to allow the canopy material to span or stretch out in an opened state of the umbrella, and to collapse or fold into a closed state for stowing or when the umbrella is not in use. Generally, long ribs are pivotally connected at one end to an upper hub with the free ends of the long ribs extending from the long hub. Short ribs are pivotally connected at one end to a location along respective long ribs and pivotally connected at another end to a lower hub. The upper hub is fixed at the upper end of the post. The lower hub is slidable relative to the upper hub along the central support post, to move towards and away from the upper hub. In the collapsed state of the umbrella, the lower hub is moved away from the upper hub, and the long ribs and the short ribs are pivoted to collapse the long ribs and the short ribs towards the post. When the lower hub is raised towards the upper hub, the short ribs and the long ribs are pivoted to cause the long ribs and short ribs to extend from the respective hub outwards from the post, thereby extending the canopy material to provide under shading the canopy.

For a side supported umbrella (see, e.g., U.S. Ser. No. 10/136,709B2), it includes a side support post having an arm supported by and extending (e.g., cantilevered) from the post, whereby the extended end of the arm supports an upper hub of a frame structure that support a canopy. A lower hub is suspended below the upper hub. Long and short ribs are provided as in the central supported umbrella. The lower hub can be drawn towards and away from the upper hub, to operate the long and short ribs in a similar manner as discussed above in reference to the central supported umbrella.

In recent years, motorized umbrellas have been proposed to provide users with automated opening and closing functions. For example, see, US20080023053A1, U.S. Pat. Nos. 8,757,183, 7,188,633, 20050072451A1, KR101005019B1, U.S. Ser. No. 10/499,715, U.S. Ser. No. 10/538,937 and U.S. Ser. No. 10/912,357. Some of the umbrellas disclosed in these patent publications purportedly are 'smart' or 'intelligent' with various levels of automation to facilitate user use of the umbrella. However, the structures of these umbrellas are quite complex requiring extensive structural and drive components. The extensive structural and drive components increase production costs and maintenance costs for these umbrellas.

For these umbrellas, the motor drive components and the separate control components are integrated into the structure of the umbrella assemblies. These components are typically provided either at the base of the umbrella assemblies, or along the post of the umbrella assemblies. Further for those equipped with a solar panel, the solar panel is positioned above the canopy of the umbrella assembly. Part of the increased production costs is the result of required integration of the electronic and drive components for the 'smart' or 'intelligent' umbrellas during production assembly, which further required running of electrical wires to interconnect the various components distributed within the umbrella assembly, from the solar panel to the battery unit to the drive motor and the electronic components. Typically, production assembly of regular umbrellas requires lower skill labor, but with the additional more complex drive components and control components, higher skill labor would be required. Furthermore, to minimize user assembly of these umbrellas with complex structural and drive components, these umbrellas are shipped in a configuration with the complex structural and drive components preassembled/integrated in a rather bulky overall configuration, thus requiring higher shipping costs. To reduce shipping costs, higher level of integration of the 'smart' or 'intelligent' components would be required, but that would lead to further increased production costs. A failed component that was integrated into the umbrella structure would require more complicated procedures to repair or replace the failed component.

There remains a need for a simple and reliable structure for a motorized/powered collapsible umbrella that can be produced and shipped at reduced costs, and easy to be assembled and operated by users.

SUMMARY OF THE INVENTION

In accordance with one aspect, the present invention is directed to a motorized umbrella assembly, that comprises a support structure (e.g., a central post or a side post); a canopy comprising: a frame structure supported by the support structure; and a flexible canopy material (e.g., canvas, fabric, etc.) supported on the frame structure; and a centralized drive module comprising a plurality of modularized units removably/detachably attached, and wherein the drive module is structurally and operatively coupled to the frame structure to operate to open/extend or close/collapse the canopy between an opened configuration and a closed configuration. In one embodiment, the modularized units are configured to be removably/detachably stacked into a stacked structure of the overall drive module using quick connect couplings, thereby facilitating quick removably/detachably coupling between the bottom side of one modularized unit to the top side of another modularized unit, to facilitate configuring a stack of modularized units removably/detachably attached to form the overall drive module, and wherein the interfacing top and bottom sides of the adjacent modularized units are provided with complementary electrical connection terminals (e.g., complementary conductive pogo pins and contact pads, complementary electrical connectors, etc.). The modularized units may be provided with quick connect features at the top and bottom sides of respective housings of the modularized units to facilitate quick connect couplings of adjacent modularized units. In one embodiment, the quick connect features at the top and bottom sides of the respective housings of the modularized units are similar to facilitate interchangeability of the modularized units for stacking in a desired order of the modularized units in the stacked structure.

In one embodiment, the drive module is modularized with a separate power supply unit (including a rechargeable battery) and a separate drive module (comprising all the electric components, e.g., drive motor, drive transmissions, and control circuitry). The power supply unit is removably/detachably attached (e.g., by a plug and twist locking interface, threaded interface, and/or fasteners) to the drive unit. The power supply unit is detachable from the drive unit, e.g., to replace the rechargeable battery, etc. In one embodiment, the drive module comprises: a modularized drive unit (which comprises a drive motor and associated drive transmissions such as reduction gears, etc.); and a modularized power supply unit removably/detachably attached to the drive unit, wherein the power supply unit supplies electrical power to the drive module. The power supply unit has a power supply housing having a top side and a bottom side and the drive unit has a drive housing having a top side and a bottom side, and wherein the bottom side of the power supply housing is configured to be removably/detachably attached to the top side of the drive housing. The motorized umbrella assembly as in claim 6, wherein the interfacing surfaces of the top side of the drive housing and the bottom side of the power supply housing have complementary electrical connection terminals. In one embodiment, the drive unit or the power supply unit comprises a control unit.

In one embodiment, the frame structure of the canopy comprises: a support hub assembly having an upper hub and a lower hub below the upper hub, wherein the upper hub is connected to the support structure; a plurality of longitudinal long ribs, wherein each long rib has an end removably coupled to the upper hub at an upper end of the support hub assembly; a plurality of longitudinal short ribs, each comprising a first end pivotally coupled to a location along a corresponding long rib and a second end removably coupled to the lower hub at a lower end of the support hub assembly, wherein the canopy material is supported on the long ribs, spanning over the long ribs, wherein the drive module operates to open/extend or close/collapse the frame structure of the canopy between the opened configuration and the closed configuration by varying the distance between the upper hub and the lower hub to pivot the short rib relative to the long rib, whereby the canopy is closed/collapsed when the lower bub is lowered away from the upper hub, and the canopy is opened/extended when the lower hub is raised towards the upper hub.

In one embodiment, the drive unit is removably/detachably attached to a top side of the upper hub, wherein the drive motor is operatively coupled to the lower hub via a pulley and a cable that runs through a hole provided in the upper hub and having a distal end connected to the lower hub, wherein the drive motor is operated to wind the cable onto the pulley to raise the lower hub towards the upper hub to open the frame structure of the canopy, and to unwind the cable from the pulley to lower the lower hub away from the upper hub to close the frame structure of the canopy, wherein the lower hub is lowered under the weight of the collapsible frame structure of the umbrella assembly as tension in the cable is released by unwinding from the pulley as driven by the drive motor. In one embodiment, the top side of the upper hub is provided with quick coupling features, whereby the quick coupling features at the bottom of the motor drive unit matches the quick coupling features at the top side of the upper hub to facilitate quick coupling of the bottom side of the stacked drive module to the top side of the upper hub of the frame structure of the canopy.

In a further embodiment, the modularized units of the drive module further comprise a modularized sensor unit removably/detachably attached to the power supply unit, wherein the sensor unit has a bottom side that is configured to be removably/detachably attached to the top of the power supply housing. The sensor unit may comprise at least one of a wind sensor, atmospheric pressure sensor, temperature sensor, tilt sensor, motion sensor, oscillation sensor (for sensing side-way movements of the umbrella assembly), etc., and wherein separate sensors or combination of sensors are embodied in separate modularized units, thereby a user can customize the configuration of the umbrella assembly with desired sensors.

In one embodiment, the power supply unit comprises a modularized battery unit and a modularized solar panel unit.

In a further embodiment, the modularized units of the drive module further comprise a modularized solar panel unit removably/detachably attached to the top side of the sensor unit or the power supply unit, wherein the solar panel unit includes a solar panel and a casing that has a bottom side provided with quick connect features to the adjacent.

In one embodiment, the support structure of the canopy comprises one of: (a) a central support post extending through the lower hub and having an upper distal end supporting the upper hub of the frame structure, and wherein the long ribs and short ribs of the frame structure extends away from the central post in the opened configuration, and (b) a side support post and a side support arm cantilevered and extending from the side support post, wherein an extended end of the support arm supports the upper hub of the frame structure, and wherein the frame structure is on one side of the side support post. In one embodiment, in the case of (b), a distal end of the side support arm is slidably coupled to the side support post to facilitate the distal end to slide up and down the side support post when the frame structure of the canopy opens and closes, respectively, wherein the support structure further comprises a support brace having one end pivotally attached to the top of the side support post and another end pivotally attached to a location along the side support arm. In one embodiment, the side support arm comprises one of the long ribs in the frame structure of the canopy.

In another aspect, the present invention is directed to a modularized drive assembly for an umbrella assembly, comprising a plurality of modularized units, including: a drive unit which comprises a drive motor and associated drive transmissions such as reduction gears, etc.; and a power supply unit removably/detachably attached to drive unit wherein the power supply unit supplies electrical power to the drive module, and wherein the drive unit is structurally and operatively coupled to a frame structure of a canopy of the umbrella assembly to operate to open/extend or close/collapse the canopy between an opened configuration and a closed configuration. As noted above, in one embodiment, the modularized units are configured to be removably/detachably stacked into a stacked structure of the overall drive module using quick connect couplings, thereby facilitating quick removably/detachably coupling between the bottom side of one modularized unit to the top side of another modularized unit, to facilitate configuring a stack of modularized units removably/detachably attached to form the overall drive module, and wherein the interfacing top and bottom sides of the adjacent modularized units are provided with complementary electrical connection terminals (e.g., complementary conductive pogo pins and contact pads, complementary electrical connectors, etc.). Further, the modularized units may be provided with quick connect features at the top and bottom sides of respective housings of the modularized units to facilitate quick connect couplings of adjacent modularized units. The quick connect features at the top and bottom sides of the respective housings of the modularized units may be similar to facilitate interchangeability of the modularized units for stacking in a desired order of the modularized units in the stacked structure. The modularized units may take on the structural embodiments noted above.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals/designations designate like or similar parts throughout the drawings.

Figure 1:
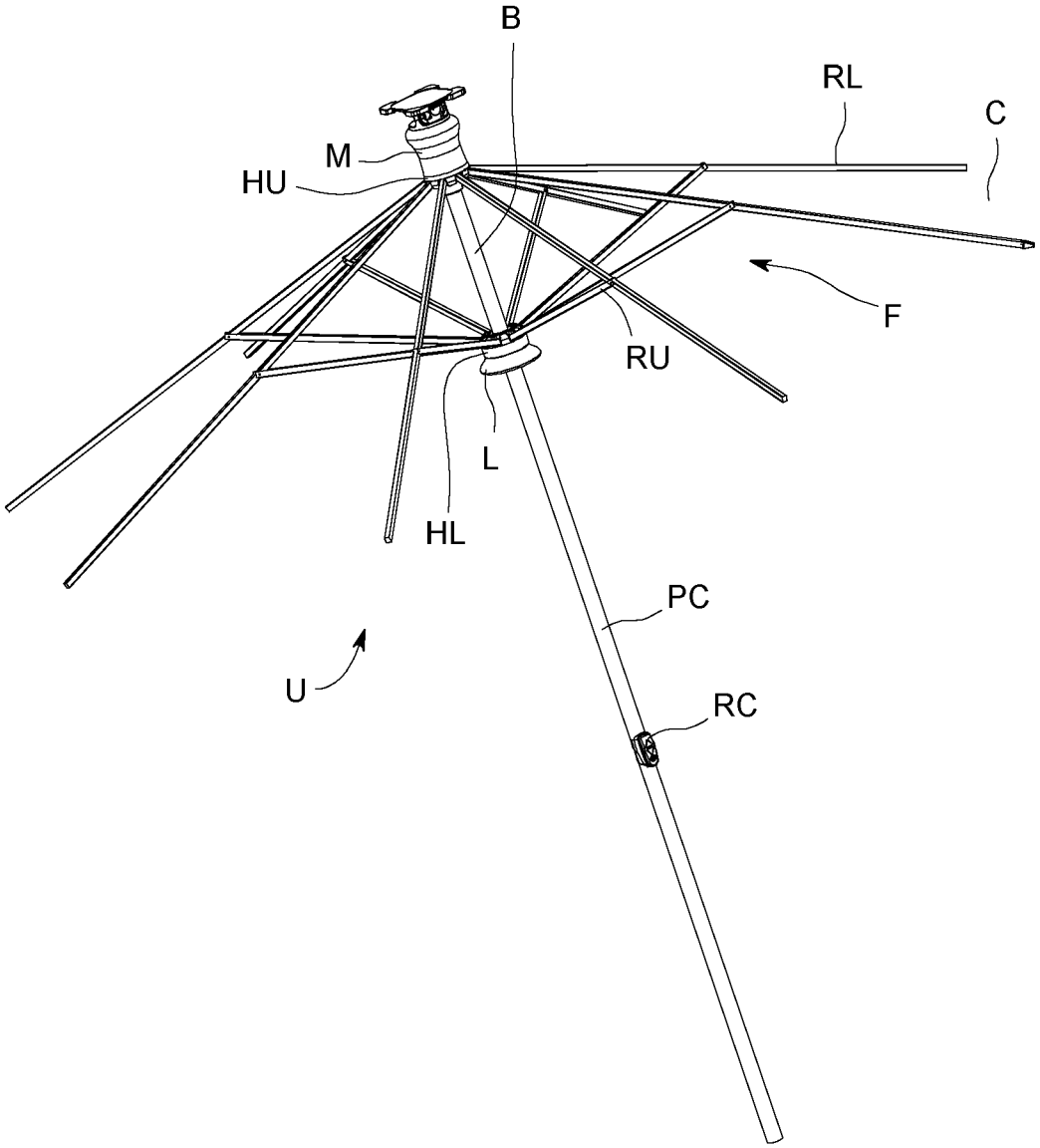
FIG. 1 is a perspective view of a motorized umbrella assembly having a modularized drive module, in accordance with one embodiment of the present invention.

The drawings are further annotated to facilitate understanding of the written description hereinbelow in reference to the structures are features illustrated in the drawings.

DETAIL DESCRIPTION OF ILLUSTRATED EMBODIMENT

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

The present invention provides a simple and reliable structure for a smart, motorized/powered collapsible umbrella that can be produced and shipped at reduced costs, and easy to be assembled and operated by users, which overcomes the drawback of the prior art smart umbrellas. The inventive smart umbrella comprises an umbrella assembly and an inventive drive module adapted for use with the umbrella assembly.

FIG. 1 is a perspective view of a motorized umbrella assembly having a modularized drive module M, in accordance with one embodiment of the present invention. As illustrated, generally the inventive collapsible umbrella assembly U comprises a support structure (e.g., a central post PC), a frame structure F supported by the support structure (central post PC, side support post PS), comprising: a support hub assembly having an upper hub HU and a lower hub HL; a plurality of long ribs RL (which may be modular comprising a first rib section and a second rib section removably connected by a pivot rib coupler, wherein each long rib has an end removably coupled to the upper hub at an upper end of the support hub assembly); a plurality of short rib RS (which may be in the form of a plurality of third rib sections, each comprising a first end removable coupled to the pivot rib coupler and a second end removably coupled to the lower hub at a lower end of the support hub assembly, wherein each pivot rib coupler is configured to pivotal the third rib section relative to the first and second rib sections that are removably coupled to the pivot rib coupler). The rib sections may be similar to those disclosed in U.S. patent application Ser. No. 17/957,857 filed on Sep. 30, 2022 (to be published), which is fully incorporated by reference herein. A canopy comprising a flexible material (e.g., canvas, fabric, etc.) is supported on the frame structure, with the flexible material spanning over the long ribs. Once assembled, the collapsible umbrella can be operated to open/extend or close/collapse the canopy in similar fashion as known collapsible umbrellas. In one embodiment, the general umbrella assembly configuration can be similar to those found in conventional central supported and side supported umbrella assembly found in the prior art, with the modifications to adopt the inventive drive module disclosed herein.

The inventive smart umbrella can be easily opened/erected/expanded for use and collapsed with minimum user intervention. This is achieved by providing an inventive centralized and modularized drive module M. FIG. 2A to 2E are perspective views of a drive module M and modularized units thereof, in accordance with one embodiment of the present invention. The inventive drive module is complete with a power supply unit P (which may include a battery in one embodiment, or a combination of a battery and a solar panel in another embodiment, or separate modularized solar panel unit O and modularized battery unit P in further embodiment, and drive unit D (which includes drive motor and associated drive transmissions such as reduction gears, etc.) to be coupled to the top of the frame structure F of the canopy C of the collapsible umbrella assembly (which could be a central supported or a side supported/cantilevered umbrella). Furthermore, the drive module M could also include a control unit T, and a sensor unit W. Most or all the various units for the drive module M are modularized, for easy assembly outside of the collapsible umbrella assembly before coupling to the top of the canopy C, as will be explained in greater details below. Hereinafter, in the illustrated embodiment of separate modularized solar panel unit O and a separate power supply unit P having a battery B and no solar panel, the power supply unit P will be interchangeably referred to simply as a battery unit P.

In the illustrated embodiment shown in FIGS. 2A to 2E, for each modularized unit, the bottom is provided with quick coupling features QB. With the exception of the top unit comprising the solar panel, the top of the other modularized units includes complimentary quick connect features QT, which allows for quick coupling between the bottom of one modularized unit to the top of another modularized unit, to facilitate configuring a stack of modularized units to form the overall drive module M. In one embodiment, the corresponding top and bottom quick connect features QT and QB of some or all of the modularized units are similar, to allow for options for interchangeability between the modularized units, so that the stack of modularized units in a desired order can be configured to form the overall drive module.

Figure 2A:
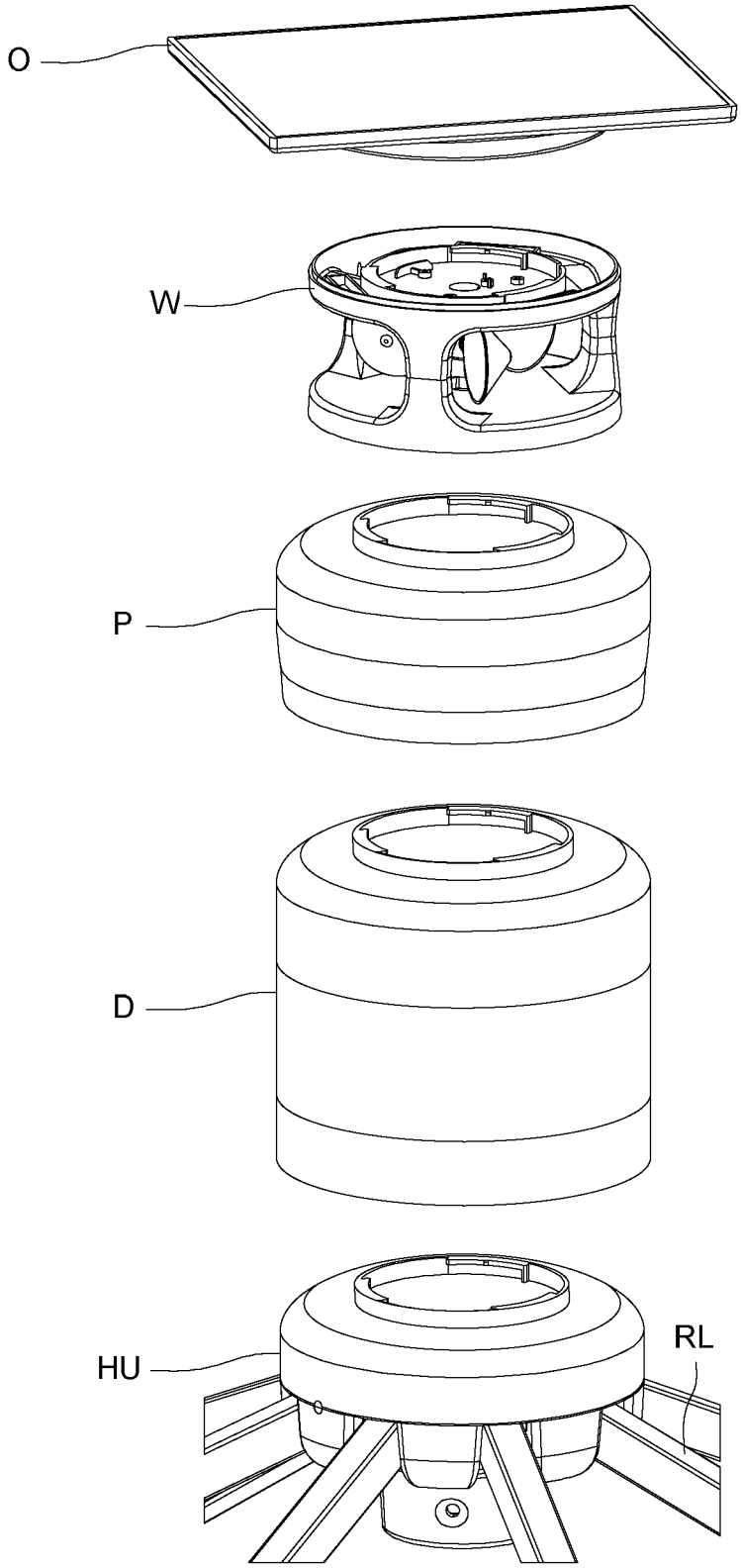
FIG. 2A to 2E are perspective views of a drive module and modularized units thereof, in accordance with one embodiment of the present invention.

As shown in FIG. 2A, the modularized units are configured to be stacked into a stacked structure of the overall drive module M, e.g., using quick connect mating or turn couplings (e.g., one-eighth or quarter-turn couplings, or screw, latch, etc. quick couplings), and one of more of the units (e.g., a sensor unit) may be omitted from the stack of units in the drive module, depending on the configuration/functionality desired by a customer. A damaged/failed unit can be simply replaced, or repaired, without having to disassembly the umbrella structure.

In the illustrated embodiment, the stack comprises a plurality of modularized units, including a solar panel unit O, a wind sensor unit W, a power supply/electrical power storage/battery unit (herein after referred to as power supply unit or battery unit P), and a motor drive unit D, in the sequence as illustrated. In the illustrated embodiment in FIG. 3A, in addition, the top of the upper hub HU is provided with complementary quick coupling features QT similar to those provided on the top of the modularized units. In particular, the quick coupling features QB at the bottom of the motor drive unit matches the quick coupling features QT at the top of the upper hub HU to allow for quick coupling of the stacked drive module to the top of the upper hub HU of the umbrella assembly (i.e., above the canopy).

Figure 2B:
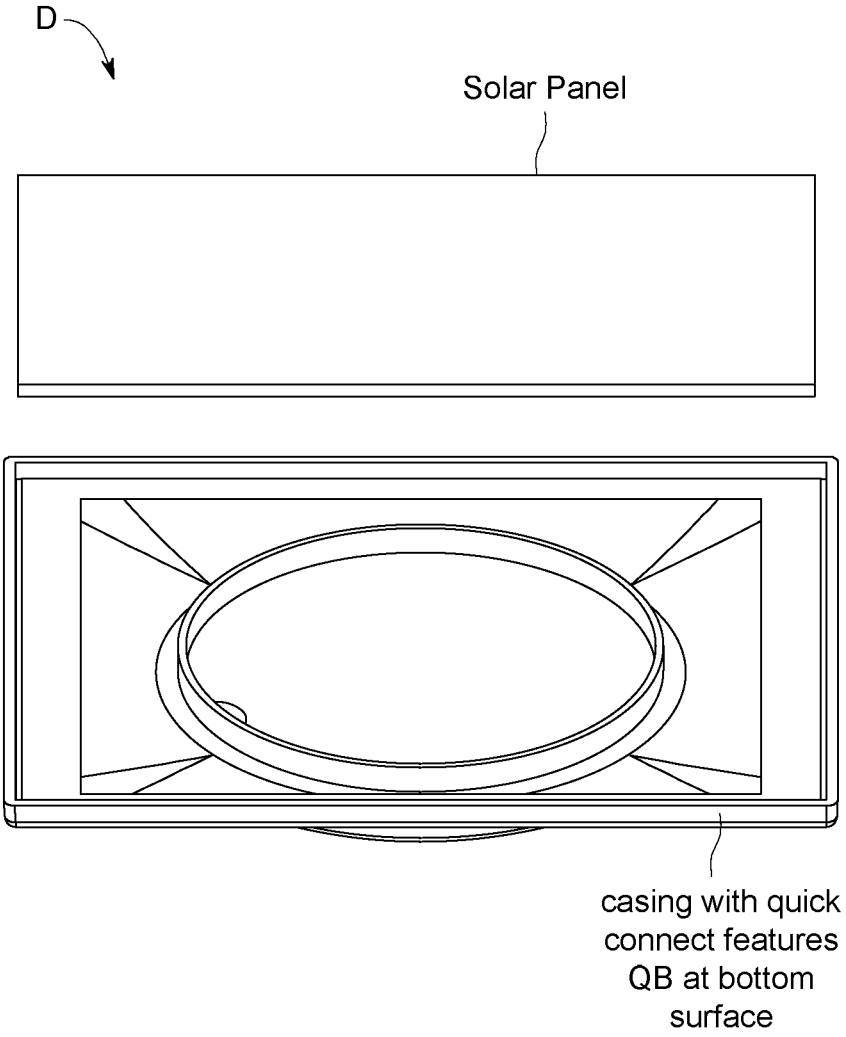

As shown in FIG. 2B, the solar panel unit O includes a solar panel that converts light (e.g., sunlight) into electrical charges. Solar panel in and of itself is well known in the art. The solar panel unit as illustrated includes a casing that has a bottom surface/side provide with quick connect features discussed above.

Figure 2C:
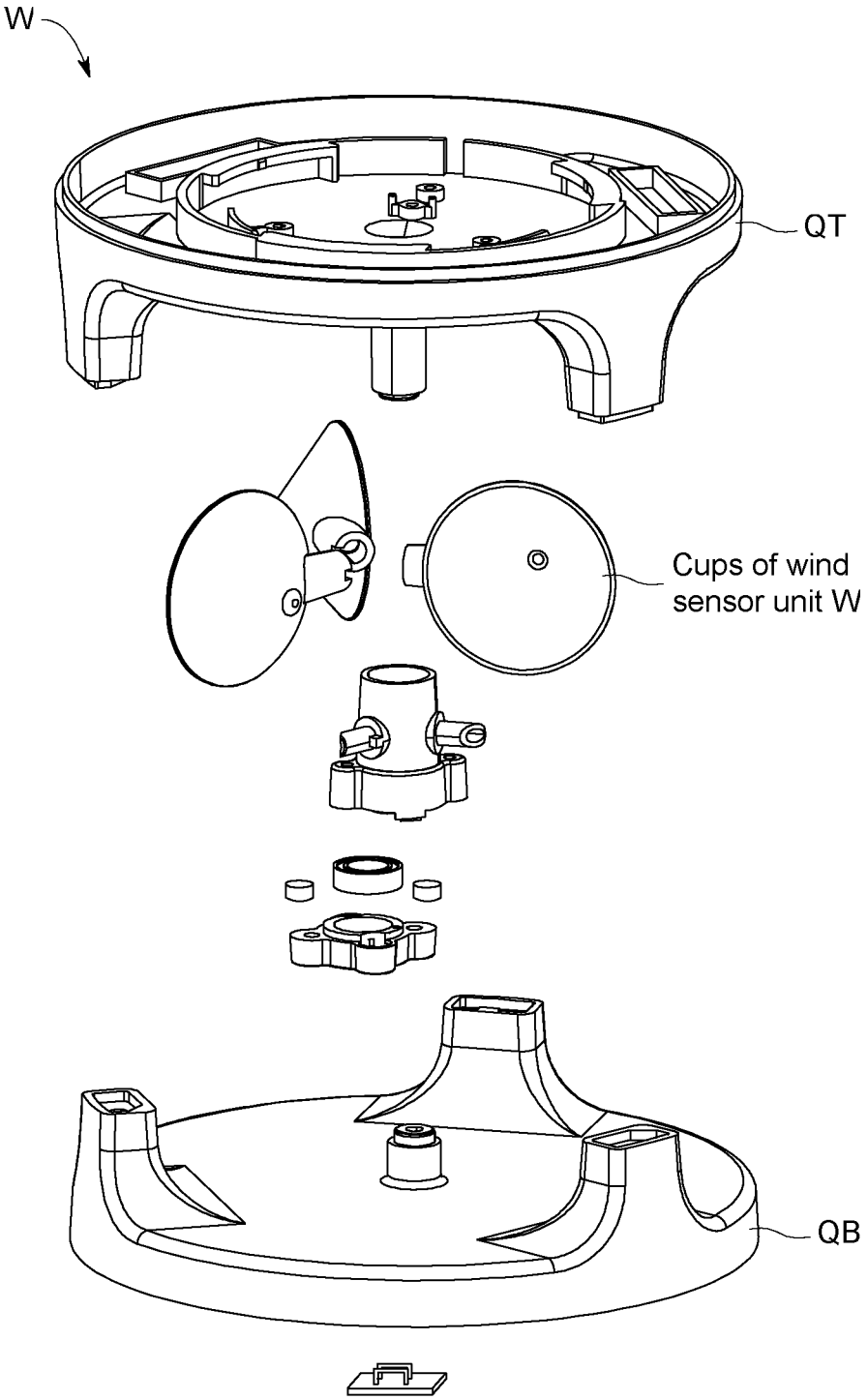

As shown in FIG. 2C, the sensor unit W could be configured to include a wind sensor, atmospheric pressure sensor, temperature sensor, tilt sensor, motion sensor, oscillation sensor (for sensing side-way movements of the umbrella assembly), etc. The various sensors could be embodied in separate modularized units, or two of more of them may be implemented in a single modularized unit. With this approach, the customer (e.g., different commercial customers such as Costco, Walmart, etc.) could customize the configurations of their product offerings with different pricing structures. In the illustrated embodiment, the wind sensor unit detects and/or measures wind conditions, which could include an anemometer for measuring wind speed and/or wind pressure, which may of one or more of the following: cup anemometer (as illustrated in the embodiment depicted in the figures), van anemometer, hot-wire anemometer, windmill anemometer, pressure anemometer, ping-pong ball anemometer, etc. The sensor unit includes a casing (in which the cups spin on a vertical axis when wind blows through openings on the side of the casing) having top and bottom surfaces/sides provided with the quick connect features discussed above.

Figure 7:
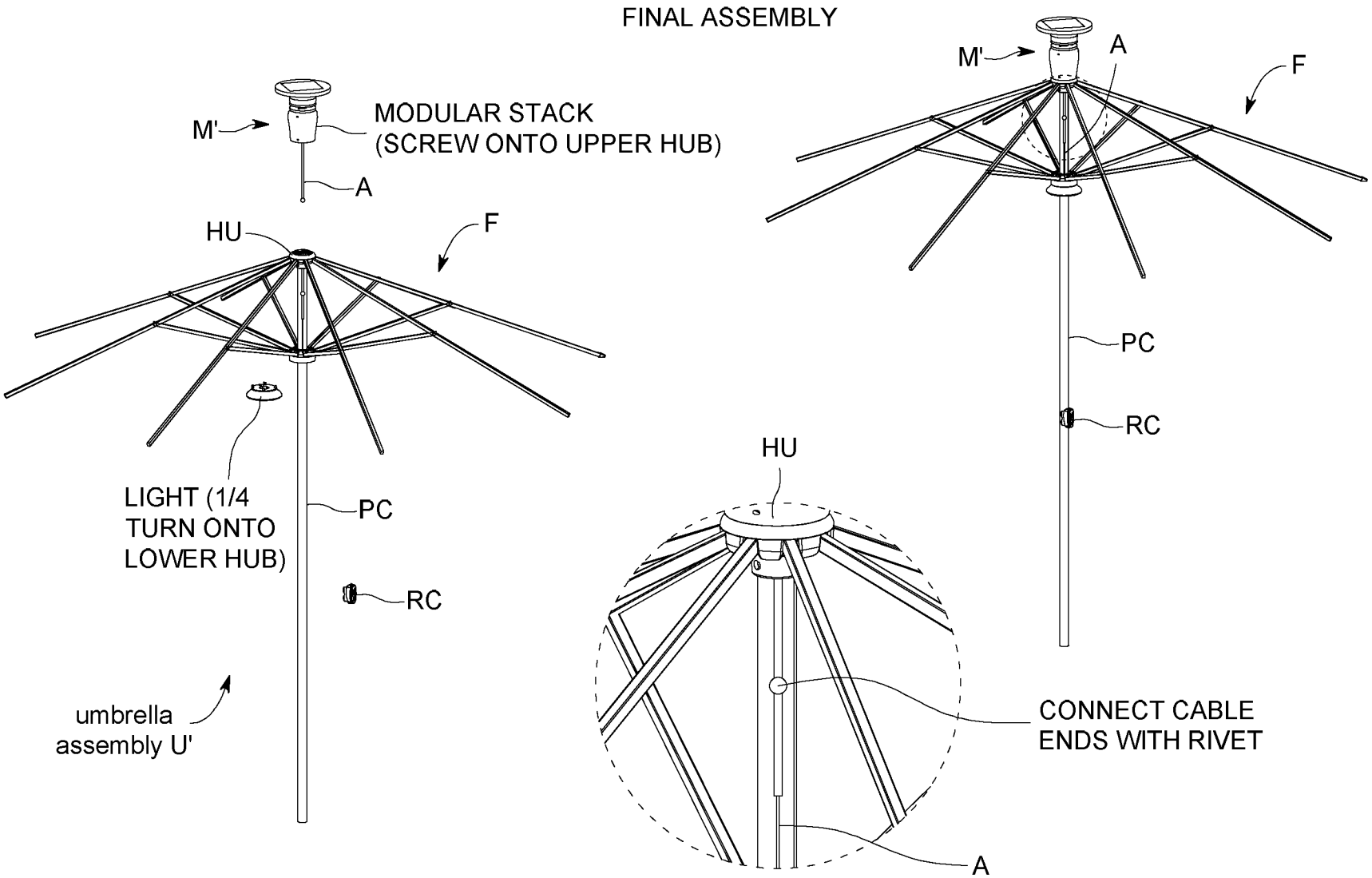
FIG. 7 is a perspective view of deployment of a drive module for a central supported umbrella assembly, in accordance with one embodiment of the present invention.

By having the sensor unit W directly below the solar panel unit O and above the power storage unit P (further discussed below), the sensor unit W is positioned as high up in the stack of modularized units in the drive module M to allow for improved sensing of wind conditions. Alternatively, the sensor unit W could be placed below the power supply unit P, as shown in FIG. 7. Prior art umbrellas typically have the batteries placed under the canopy.

Figure 2D:
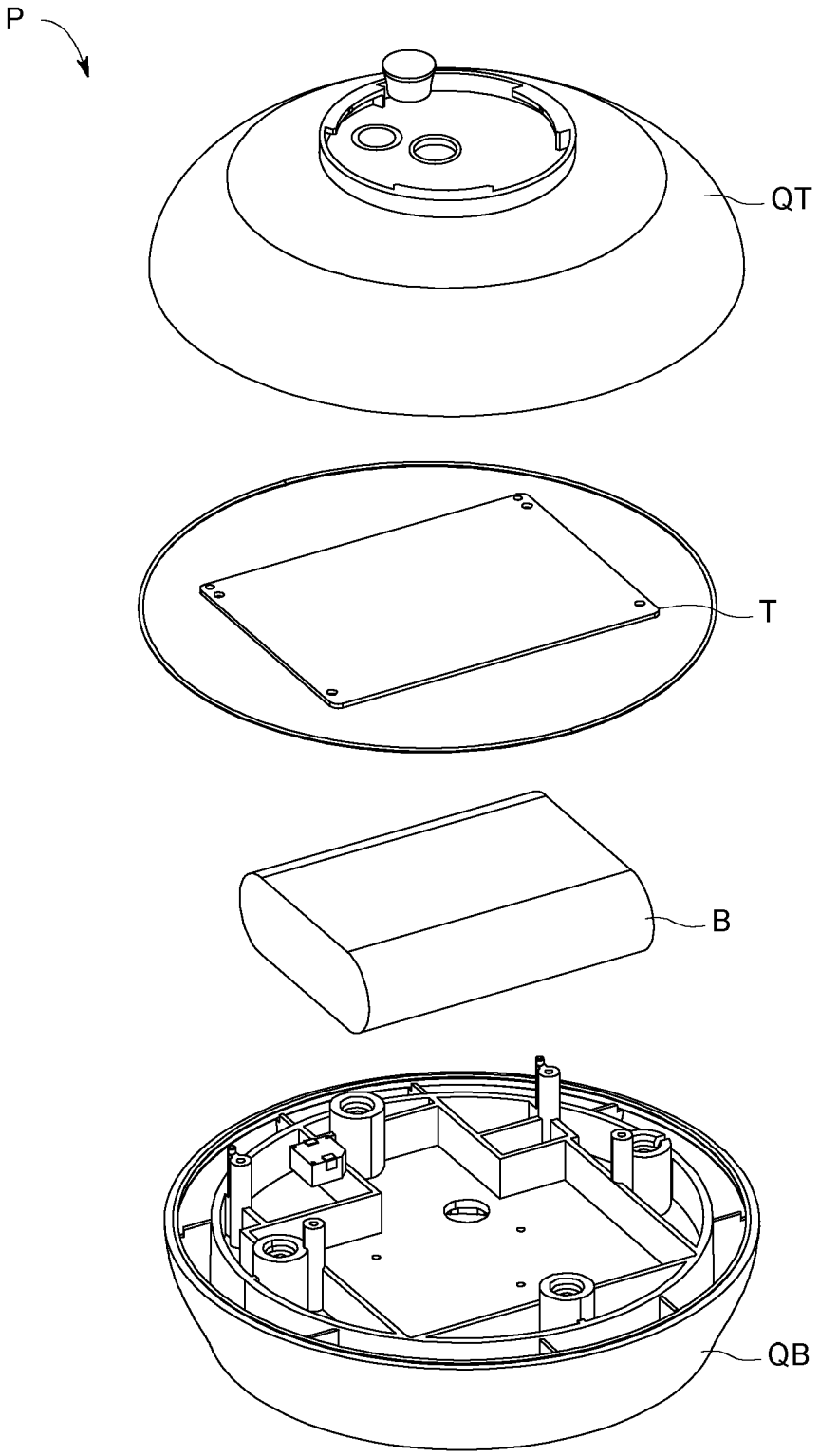

As shown in FIG. 2D, the power storage/supply unit P includes one or more rechargeable batteries B in a power supply housing, with associated power modulation and/or electrical charging controller typical for storing electrical charges from the solar panel unit O. In addition, the power supply unit P may include a charging port for receiving an external power supply to charge the batteries B in the event of insufficient charges in the batteries to close/open the umbrella assembly (e.g., in the event of cloudy, rainy or windy conditions when opening/closing of the umbrella assembly is desired). The power storage unit P includes a casing having top and bottom surfaces/sides provided with the quick connect features discussed above.

Figure 2E:
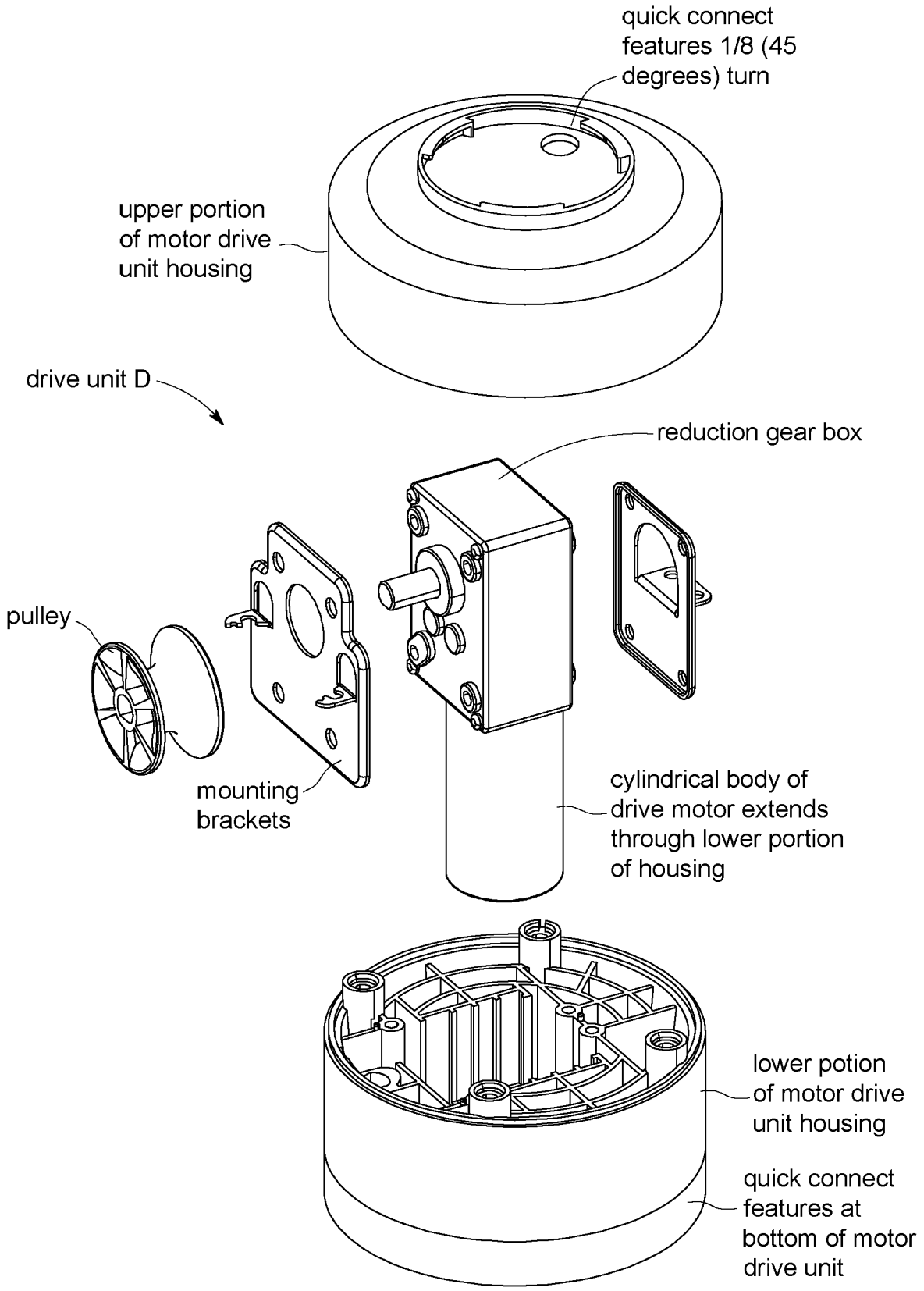

As shown in FIG. 2E, the motor drive unit D includes a drive housing supporting a drive motor. Within the drive housing could also include all the electrical components/electronics, control module, control circuitry, wirings, etc. As illustrated, the drive motor may be a DC stepper motor, which is operatively coupled to the input of a reduction gear box. The output of the reduction gear box is coupled to a pulley, which is coupled to a cable A for lifting/raising and lowering the lower hub of the umbrella assembly with respect to the upper hub, so as to open and close the canopy of the umbrella assembly. The housing of the motor drive unit has top and bottom surfaces/sides provided with the quick connect features discussed above.

FIGS. 4A to 4H are perspective views of a drive module M having a stack of modularized units and the quick coupling features QT and QB on the top and bottom sides of the housings/casings of the modularized units, in accordance with another embodiment of the present invention. This embodiment is similar in features and principle as compared to the previous embodiment.

Figure 3A:
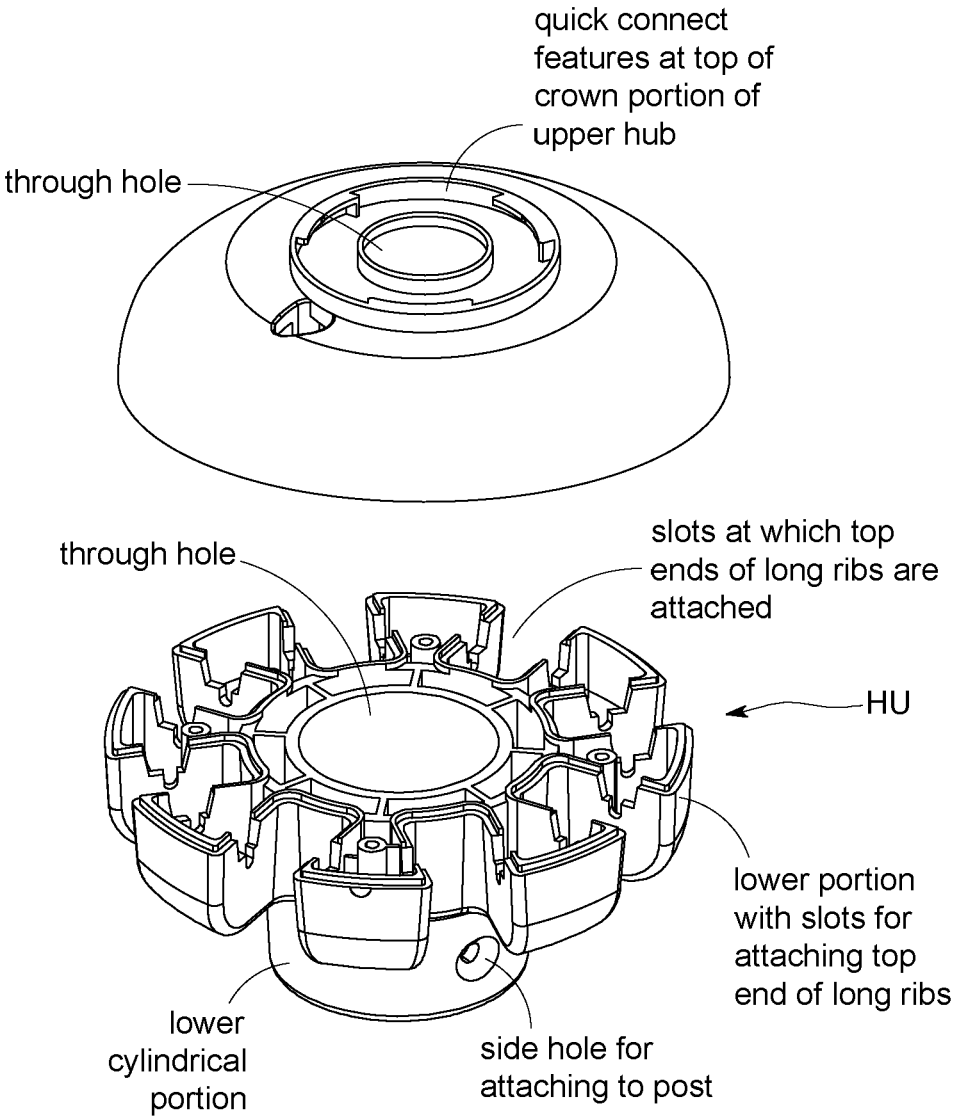
FIGS. 3A and 3B are perspective views of the upper hub and lower hub, in accordance with one embodiment of the present invention.
Figure 3B:
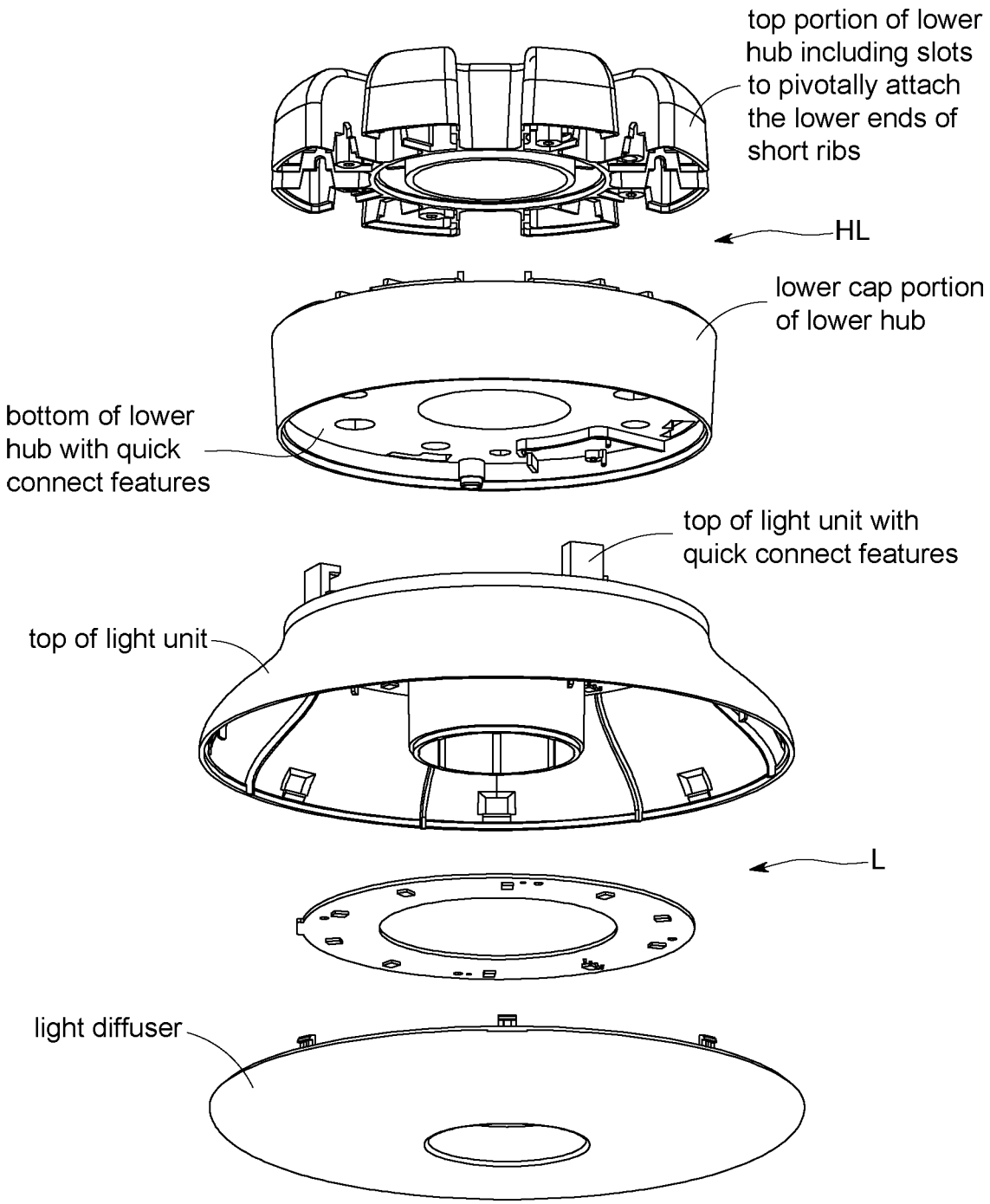

FIGS. 3A and 3B are perspective views of the upper hub HU and lower hub HL, in accordance with one embodiment of the present invention. FIG. 7 is a perspective view of deployment of a drive module M for a central supported umbrella assembly, in accordance with one embodiment of the present invention. (As illustrated in FIG. 7, the sensor unit is stacked below the power supply/battery unit, to illustrate the interchangeability of the modularized units in a stack to form the drive module.) In the illustrated embodiment based on a centrally supported umbrella, the upper hub includes a crown portion and a lower cylindrical portion extending from the bottom of the crown portion, and a center through-hole from the crown portion to the lower cylindrical portion for receiving the top end of the post in the umbrella assembly. The top surface/side of the crown portion of the upper hub is provided with the quick connect features discussed above. Around the circumference of the upper hub at the lower section of the crown portion, a circular array of slots is provided to which the top ends of the long ribs are pivotally coupled to extend radially from the upper hub. The upper hub is fixedly attached to the top of the post (e.g., using a pin/rod through a hole on the side of the lower cylindrical section of the upper hub). To further limit movement of the post through the upper hub, or to provide better support of the upper hub by the post, an annular lip of reduced diameter in the through-hole is provided at the top section of the crown portion of the upper hub, so that the post can butt against after insertion into the upper hub through-hole.

If the center post PC in the umbrella assembly U has a tubular structure (which typically is the case for increased rigidity with reduced weight of the post), the opened top end of the center post would be accessible at crown portion of the upper hub. The drive motor may be configured with a cylindrical body that is sized to be received into the opened top end of the center post (i.e., the spin axis of the drive motor is coaxial with or parallel to the longitudinal axis of the post). Indexing keys may be provided on or between the interfacing surfaces of the cylindrical body of the drive motor and the top open end of the center post to facilitate restraining rotational movement of the drive motor with respect to the center post within the top end of the center post. By inserting the drive motor into top end of the post, the overall height, and width, of the motor drive unit can be reduced, with improved structural support of the drive motor during operation of the motor.

Figure 4A:
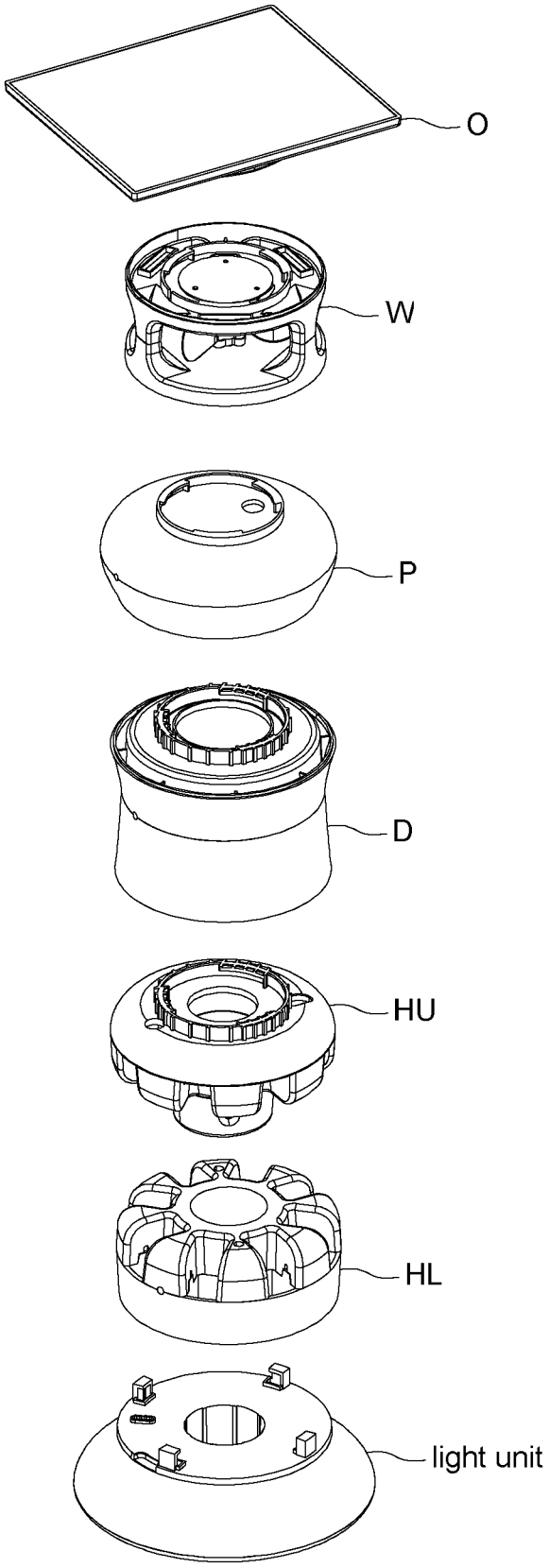
FIGS. 4A to 4H are perspective views of a stack of modularized units and the quick coupling features on the top and bottom sides of the housings/casings of the modularized units, in accordance with one embodiment of the present invention.
Figure 4B:
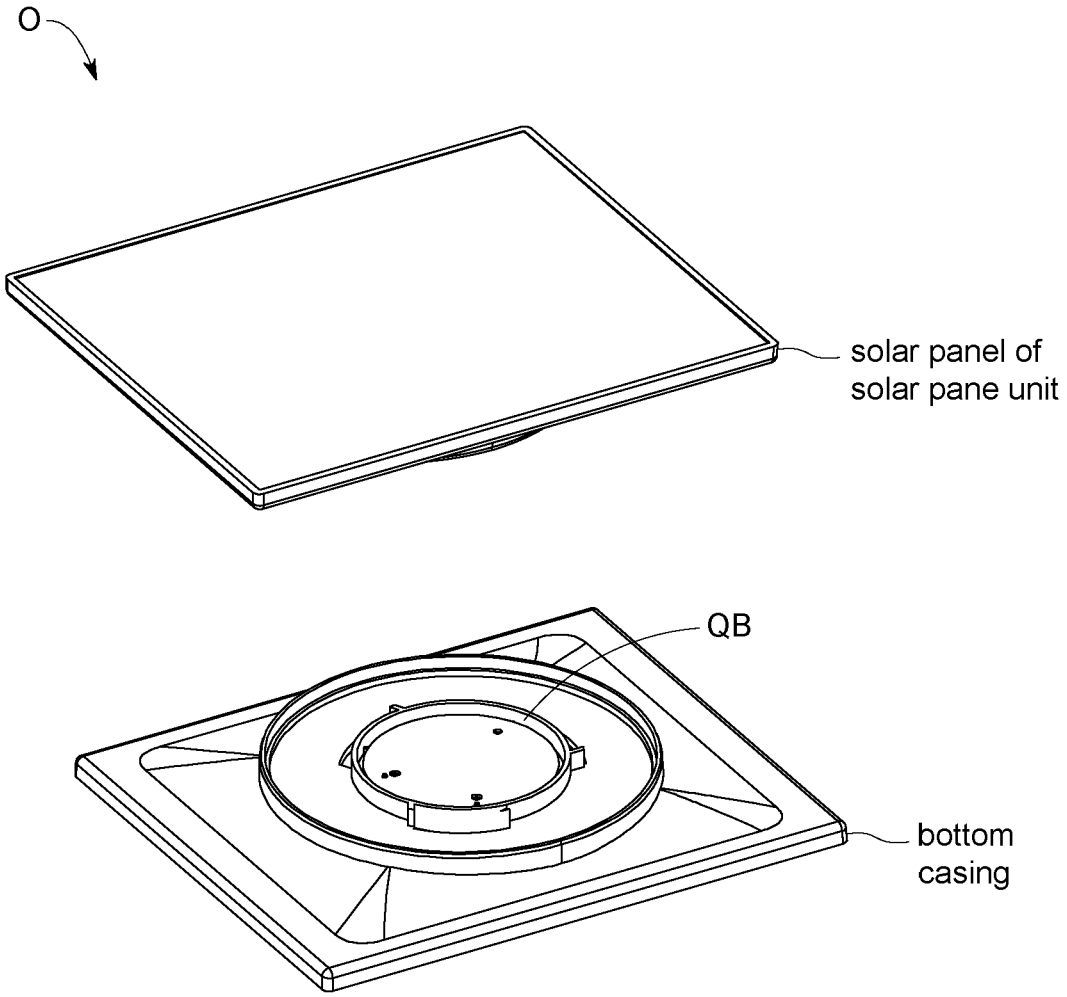
Figure 4C:
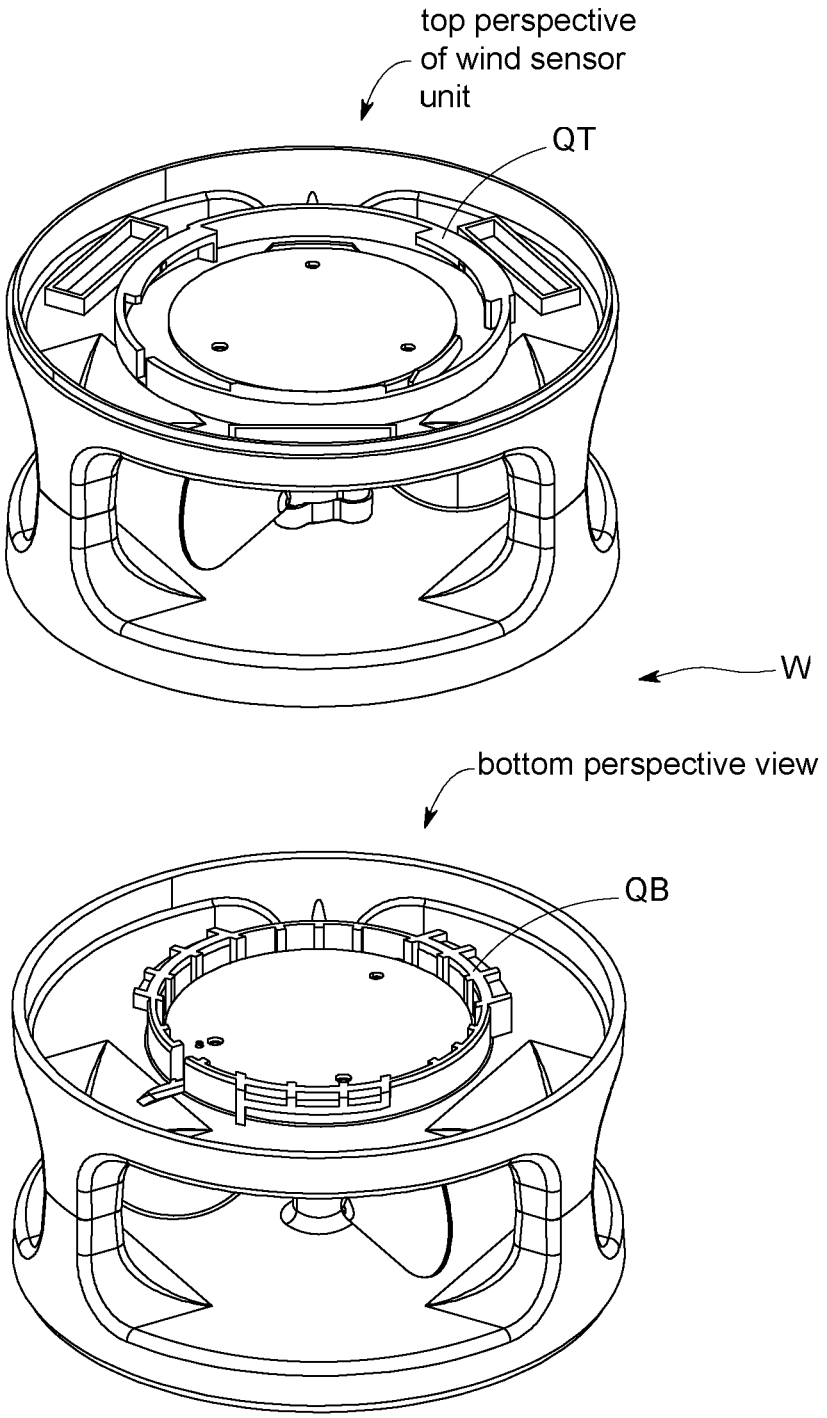
Figure 4D:
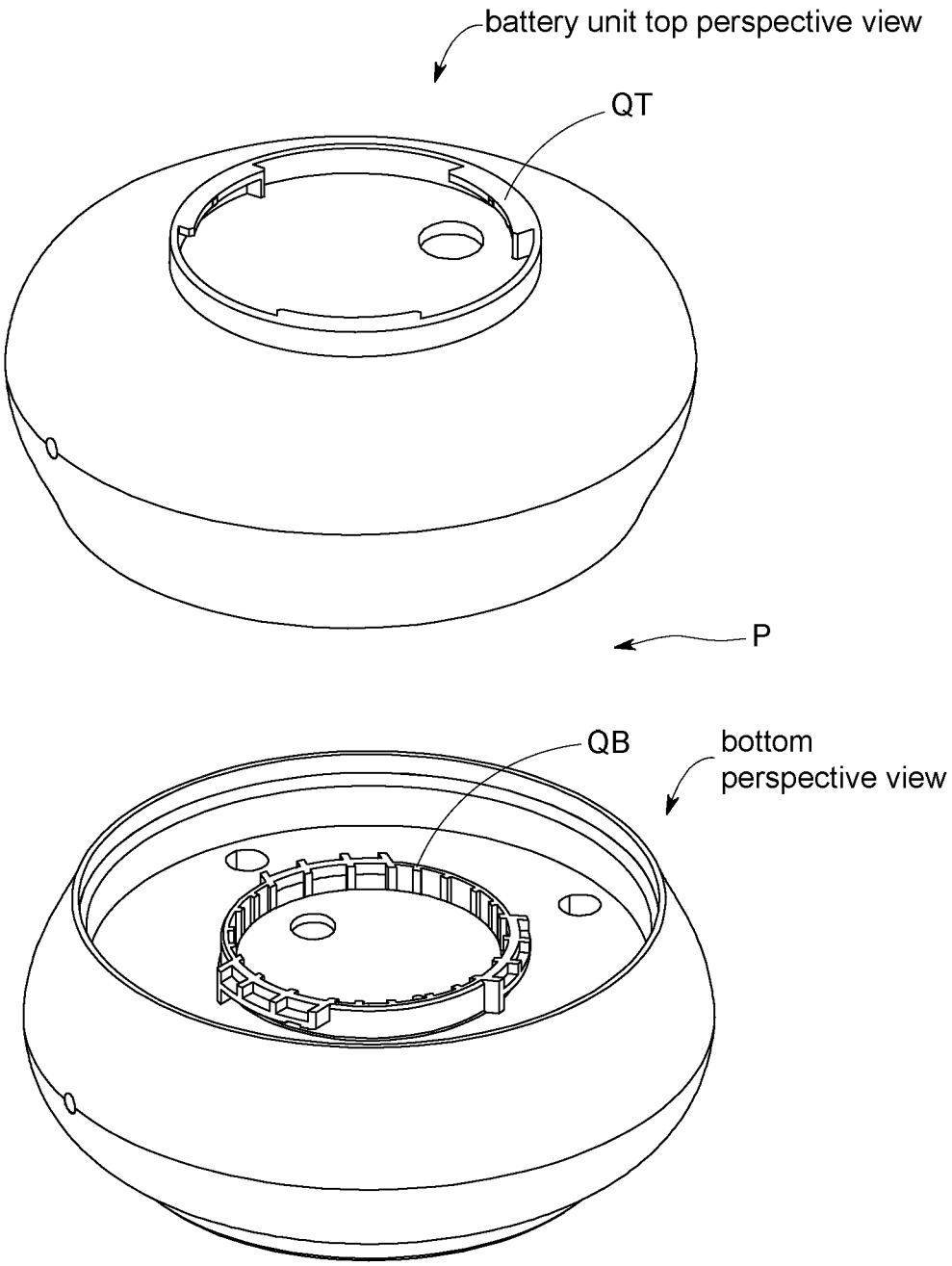
Figure 4E:
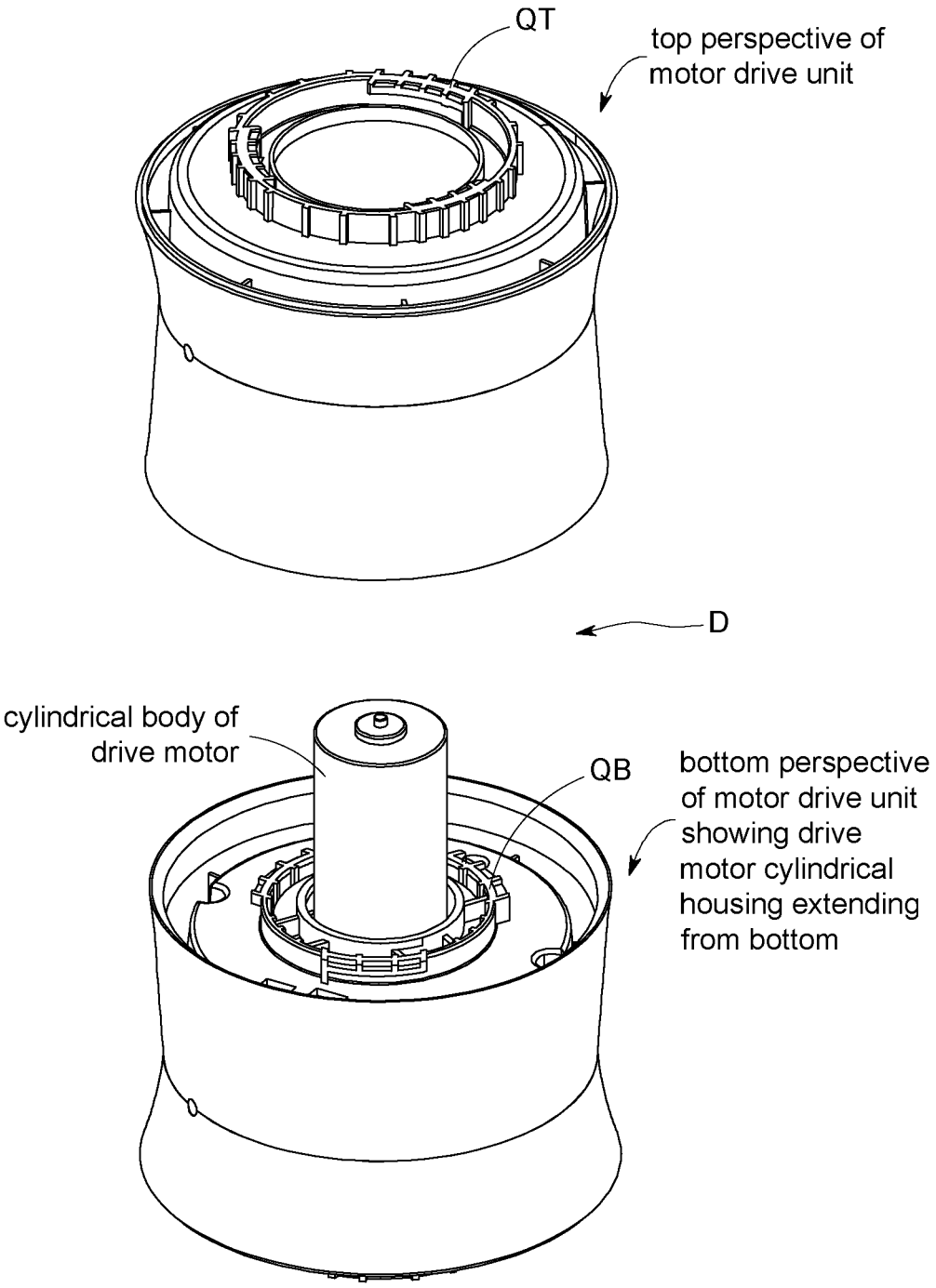
Figure 4F:
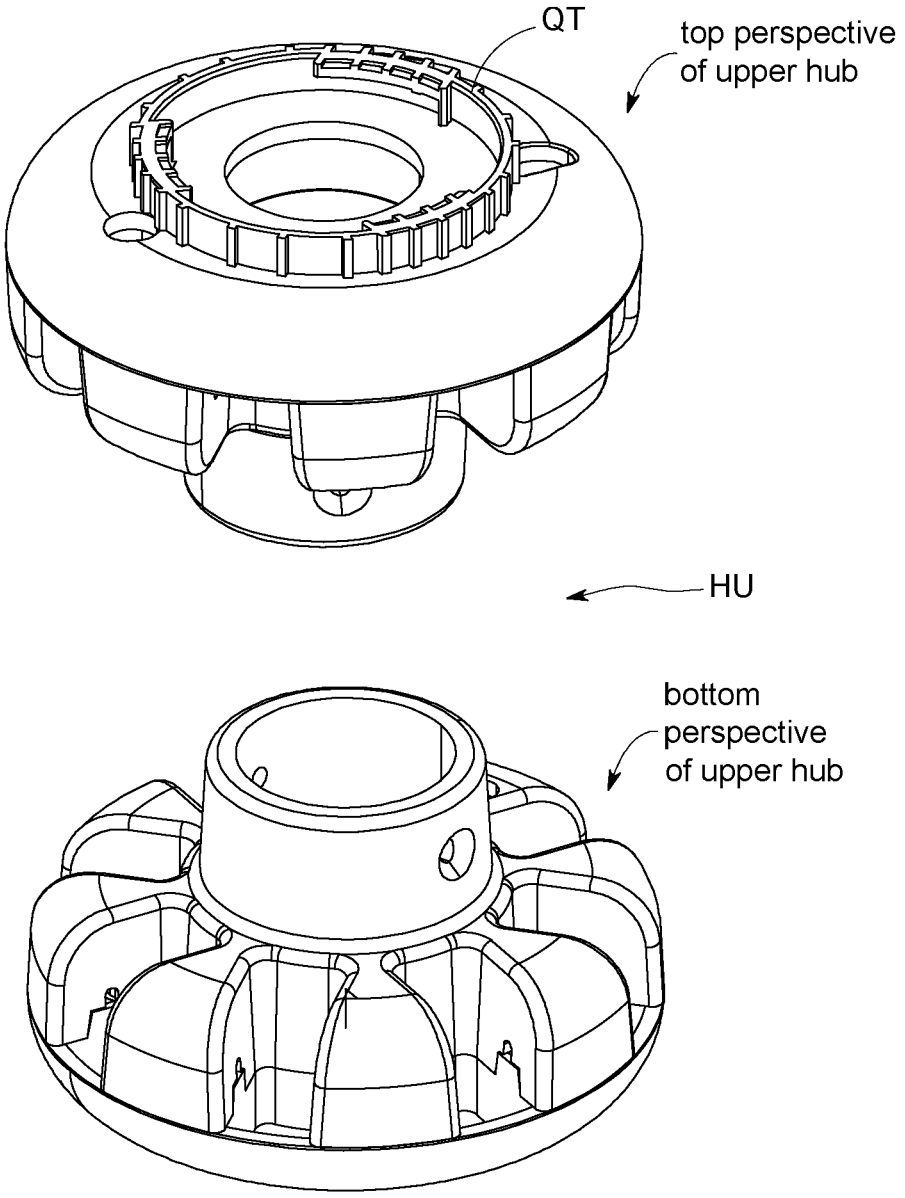
Figure 4G:
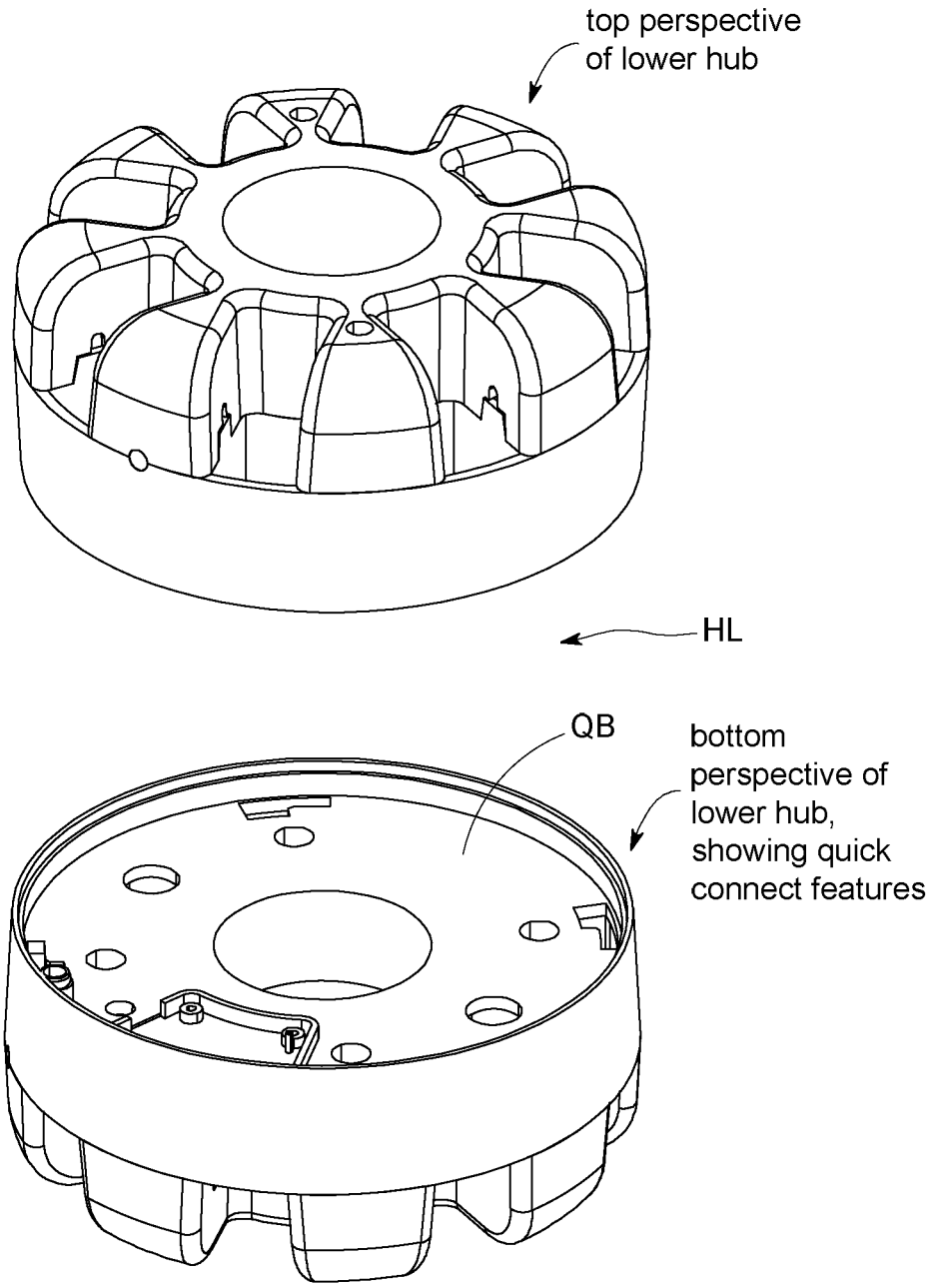
Figure 4H:
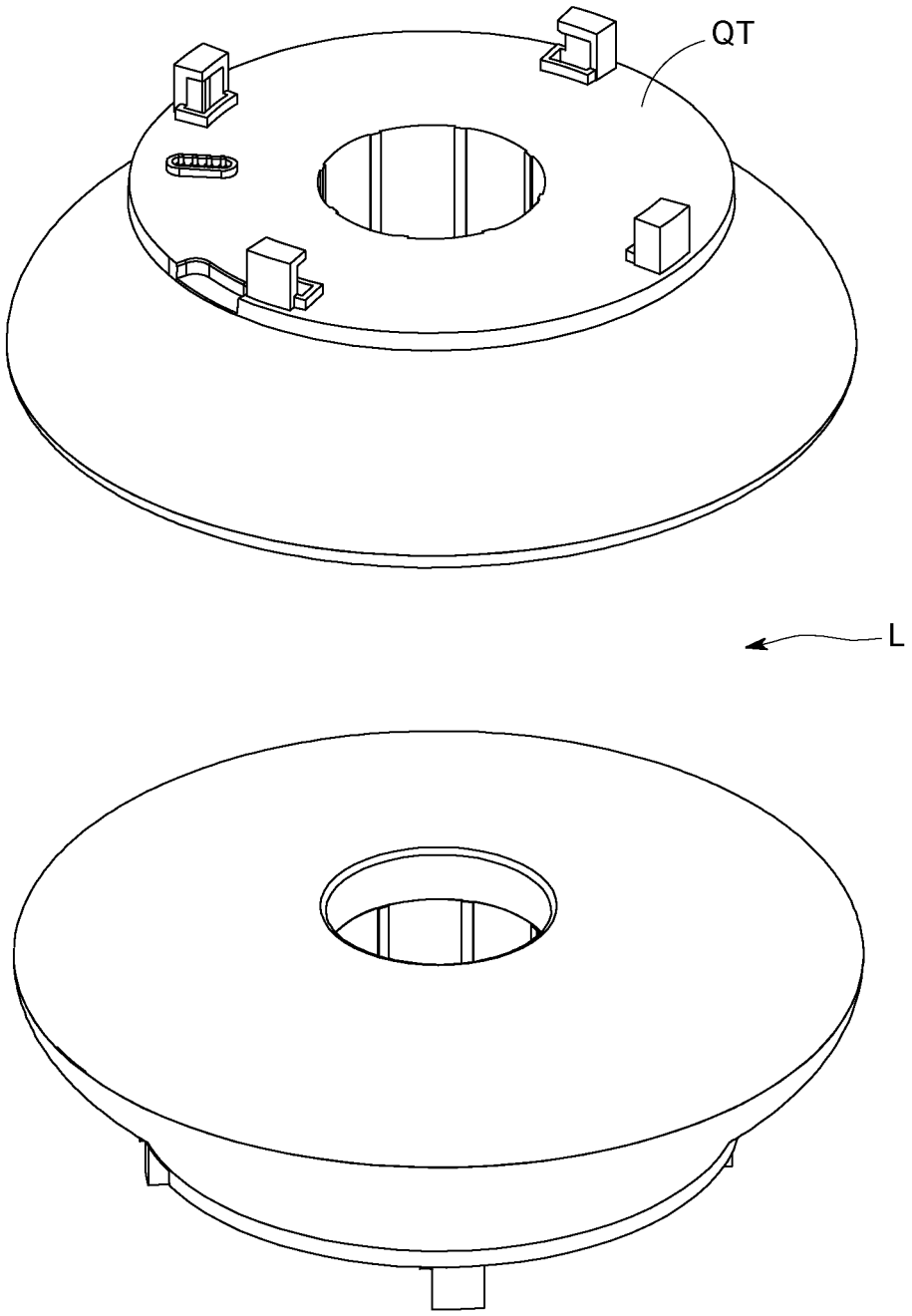

As shown in FIGS. 3B and 4G, the lower hub HL includes a top portion and a lower cap portion, and a center through-hole from the crown portion to the lower cap portion for slidably receiving the post in the umbrella assembly. Around the circumference of the lower hub at the top portion of the crown portion, a circular array of slots is provided to which the lower ends of the short ribs are pivotally coupled to extend radially from the lower hub. The lower hub can be raised and lowered with respect to the upper hub by sliding along the post. As illustrated, a cable is provided between the pulley in the motor drive unit discussed above and the lower hub. The cable runs through a hole provided in the upper hub, reaching the lower hub. If necessary, the cable is threaded through a small opening in the material of the canopy. Given the cable depends below the drive module, the drive module covers above this small opening in the canopy, which shields rain from the small opening.

In the illustrated embodiment, the lower hub HL is allowed to be lowered under the weight of the collapsible frame structure of the umbrella assembly as tension in the cable is released by unwinding from the pulley as driven by the drive motor. To raise the lower hub, the drive motor is controlled to rotate in the opposite direction to wind the cable on the pulley to pull the lower hub towards the upper hub.

In one embodiment, the fully opened configuration and the fully closed configuration of the frame assembly of the canopy may be detected by the control unit based on sensing the changes in electrical load on the drive motor. Specifically, in the closing direction, as the motor gradually unwinds the cable from the pulley, the frame structure of the canopy collapses under its own weight. Hence, less drive current is required for the motor. As the motor fully unwinds the cable from the pulley to fully lower the lower hub to close the canopy in its fully closed configuration, further turning of the motor would result in slacking of the cable, thereby requiring even lesser drive current, hence a change in load on the motor could be detected by the control unit. Alternatively, if the length of the cable is configured to fully unwind from the pulley when the canopy fully collapsed/closed, and the motor is configured to continue to turn in the same unwinding direction, the motor would transition to winding of the cable onto the pulley, thus imposing a higher load on the drive current of the motor, resulting in a change in drive current detected by the control unit. Upon sensing these changes in the load on the motor, the control unit shuts down the motor.

In the opposite opening direction, as the motor fully winds the cable onto the pulley to fully raise the lower hub to open the canopy in its fully opened configuration, further turning of the motor would result in tightening of the cable, thereby requiring a heavier drive current, hence a change in load on the motor could be detected by the control unit. Upon sensing this change inf the load on the motor, the control unit shuts down the motor.

Alternatively, or in addition, limit switches are provided to determine the fully opened and closed configurations of the canopy, e.g., by detecting the position of the lower hub with respect to the upper hub (e.g., position of the lower hub along a central post of the support structure). Limit switches can also be configured to detect the extent of winding/unwinding of the cable on the pulley. Alternatively, limit switches could detect the limits of rotation of the pulley and/or the motor. Alternatively, the control unit could count the number of rotations of the motor/pulley to determine the limit of the cable winding/unwinding from the pulley.

For the modularized units that require electrical power and/or signal transmissions to and/or from the stacked units, electrical connections may be made by way of appropriate electrical contacts provided at facing bottom and top surfaces of adjacent modularized units. Referring also to the embodiment of FIGS. 6A to 6H, a plurality of pogo pins PP and contact pads E are provided on facing/interfacing sides of adjacent modularized units. Further, indexing features are included in the interfacing quick connection features, so that the electrical contacts could positively match up in a unique orientation to prevent from mis-locating the interfacing electrical contacts. Alternatively, complementary electrical wiring connectors could be simply provided at the bottom and top of adjacent modularized units. A user would first connect the electrical connectors before connecting two adjacent modularized units. As a result, all the essential electrical connections for the various modularized units are contained within the drive module, with no wiring exposed or running outside of the overall body of the drive module.

Even if electrical contacts are not implemented, positioning features such as indexing keys may be provided as part of the quick connect features to positively position adjacent modularized units with respect to each other. In addition, or in the alternate, safety switches (e.g., microswitches) may be provided to ensure secured coupling of adjacent modularized units via the quick connect features. Until all the modularized units in the stack in the drive module are securely coupled/connected, the motor drive unit would not operate.

The wind sensor unit W communicates wind conditions (e.g., via electrical signals representing sensed wind conditions) to a control unit T. The control unit T may be incorporated within the housing of the power supply/battery unit P as in FIG. 2D and/or the motor drive unit discussed above, or as a separate modularized unit (e.g., coupled above the battery unit or above the motor drive unit. The control unit T contains the essential control circuitries, which may include processors, random access memories (RAMS), programmable read only memories (PROMS), analog/digital (A/D) converters, etc. The control unit communicates with (e.g., receive signals from) the wind sensor unit and communicates (e.g., send signals to the motor drive unit to control the functions of the motor drive unit in the drive module to operate the umbrella assembly in the manner discussed herein. When undesirable wind condition is sensed by the sensor and further determined by the controller (further discussed below), the motor drive unit in the drive module is controlled by the control unit to open or close the umbrella module as user desired. The control unit may be configured to control the motor drive unit automatically in response to the wind conditions sensed by the wind sensor unit, or as configured by the user or otherwise preprogrammed to operate the motor drive unit at certain time of day, or manually by a user on demand using a remote control RC (as explained below) or an application installed on a user electronic device (as explained below). Alternatively, the control unit may be a separate unit of the drive module (i.e., the control unit has a housing that is removably/detachably attached to the batter unit or the drive unit).

In an alternate embodiment of the present invention, the control unit T need not be incorporated into the drive module M but can be located outside of the drive module M (e.g., made part of the umbrella assembly, or a separate module attached to the umbrella assembly).

User control of the drive module M to operate the opening/closing of the umbrella assembly may be provided by a wireless control (e.g., a wireless remote control) that communicates wirelessly (e.g., by Bluetooth, Wi-Fi, infrared, RF, etc.) with a receiver provided in the control unit. In one embodiment, there is no separate user control interface (e.g., buttons, switches, etc.) in the umbrella assembly, and hence there is no need for electrical wiring to be provided within the umbrella assembly for wind sensor control signals and functions to open/close the umbrella assembly. The remote control RC includes buttons that provide a user interface to various umbrella assembly operation control functions, such as open/close, operation timers, etc. Alternatively, or in addition, an application module installed in an electronic device (e.g., a mobile phone) may be used to generate the remote-control signal and to provide further user options and settings for operating the umbrella assembly. For example, using the installed application module, the user can set the wind conditions (e.g., wind speed) at which the umbrella can remain opened, the time of day the umbrella is to remain opened, the extent of umbrella opening in dependence on wind conditions and/or sunlight or rain conditions, voice control, etc.

Further, if several smart umbrellas in accordance with the present invention are placed into operation in a group at a physical location (e.g., around a pool, or along a deck), the smart umbrellas may be controlled in unison by the user remote control and/or user application installed in a user electronic device.

Figure 8A:
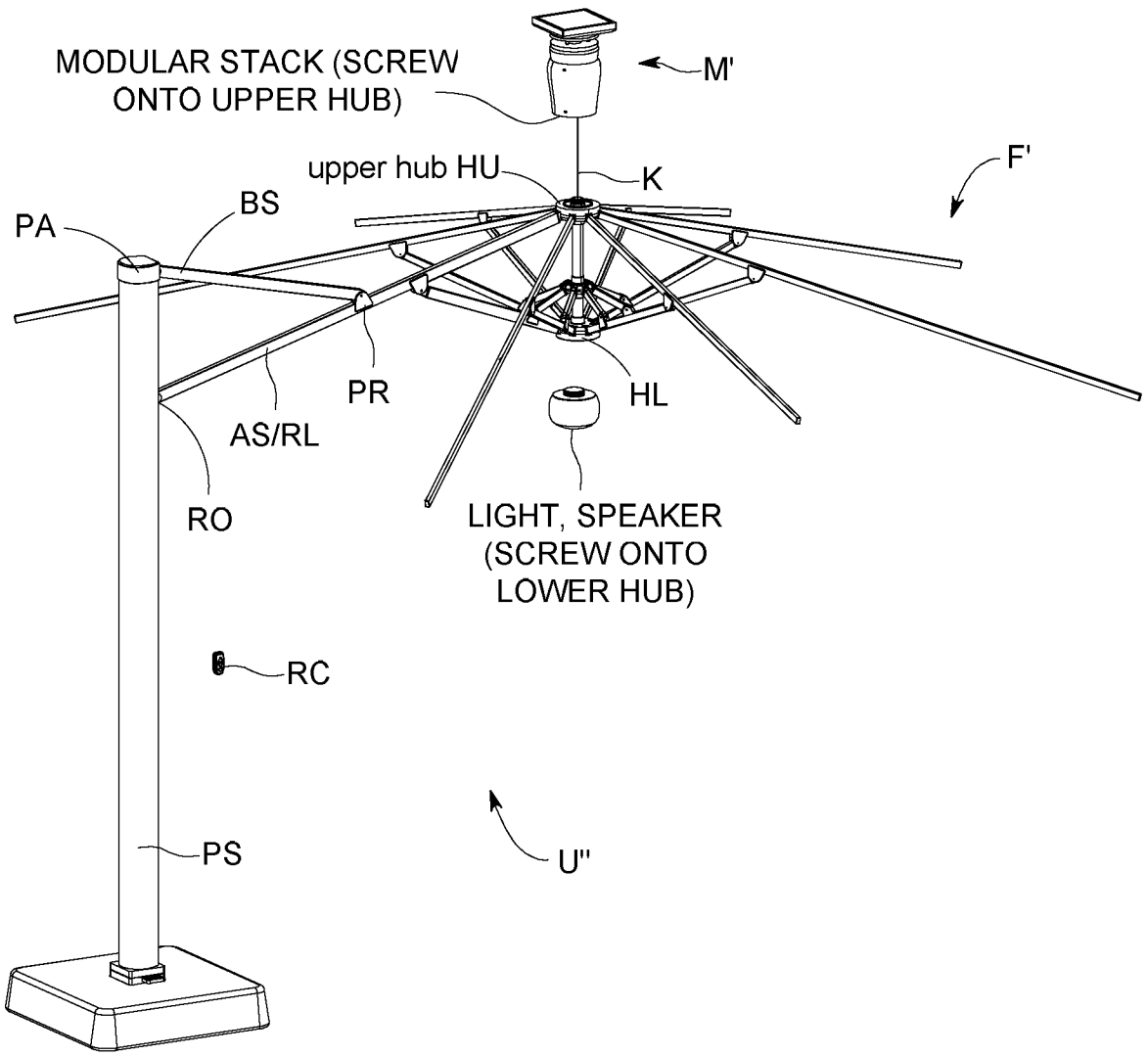
FIGS. 8A to 8E are perspective views of deployment of a drive module for a side supported cantilevered umbrella assembly, in accordance with one embodiment of the present invention.
Figure 8B:
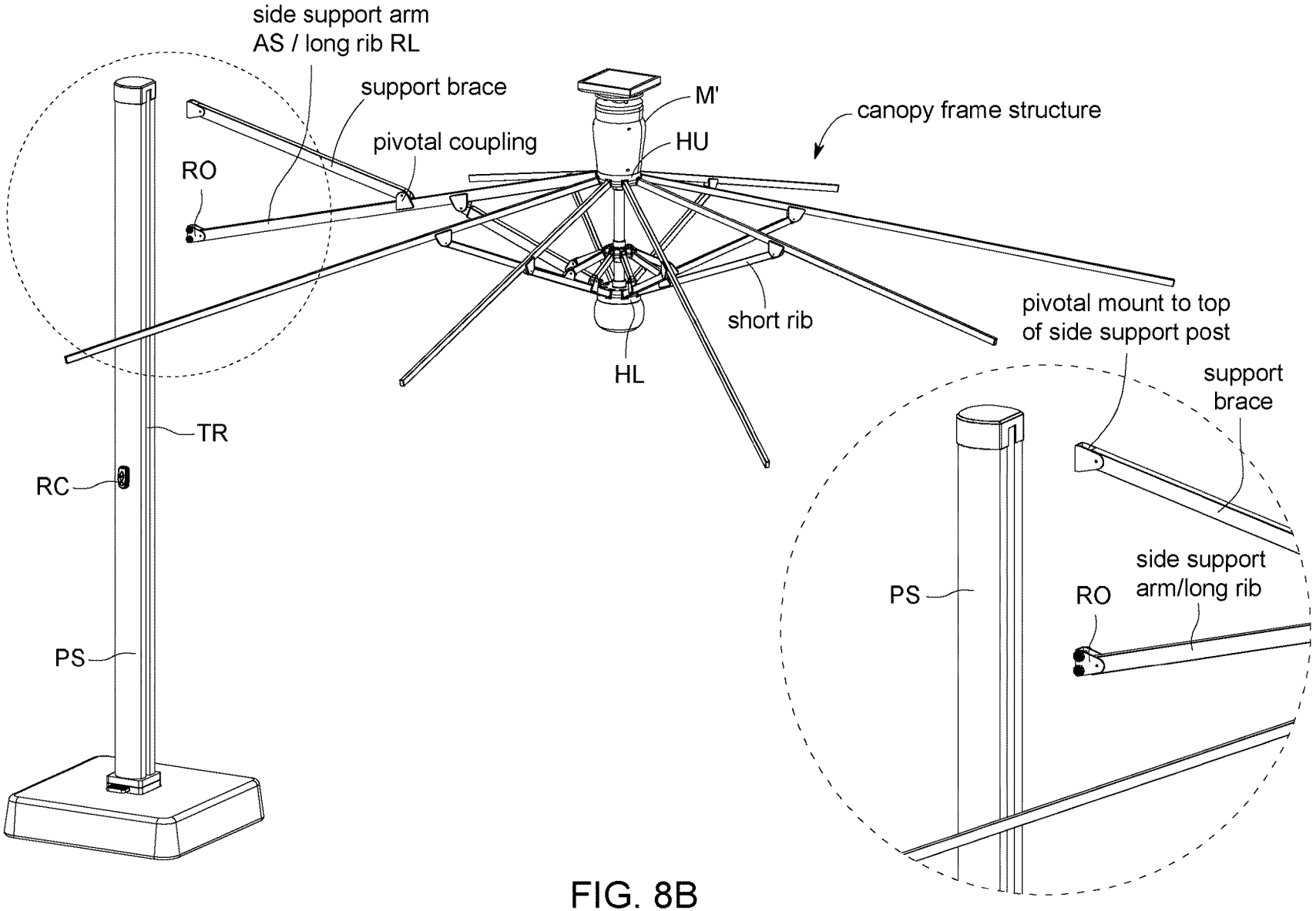
Figure 8C:
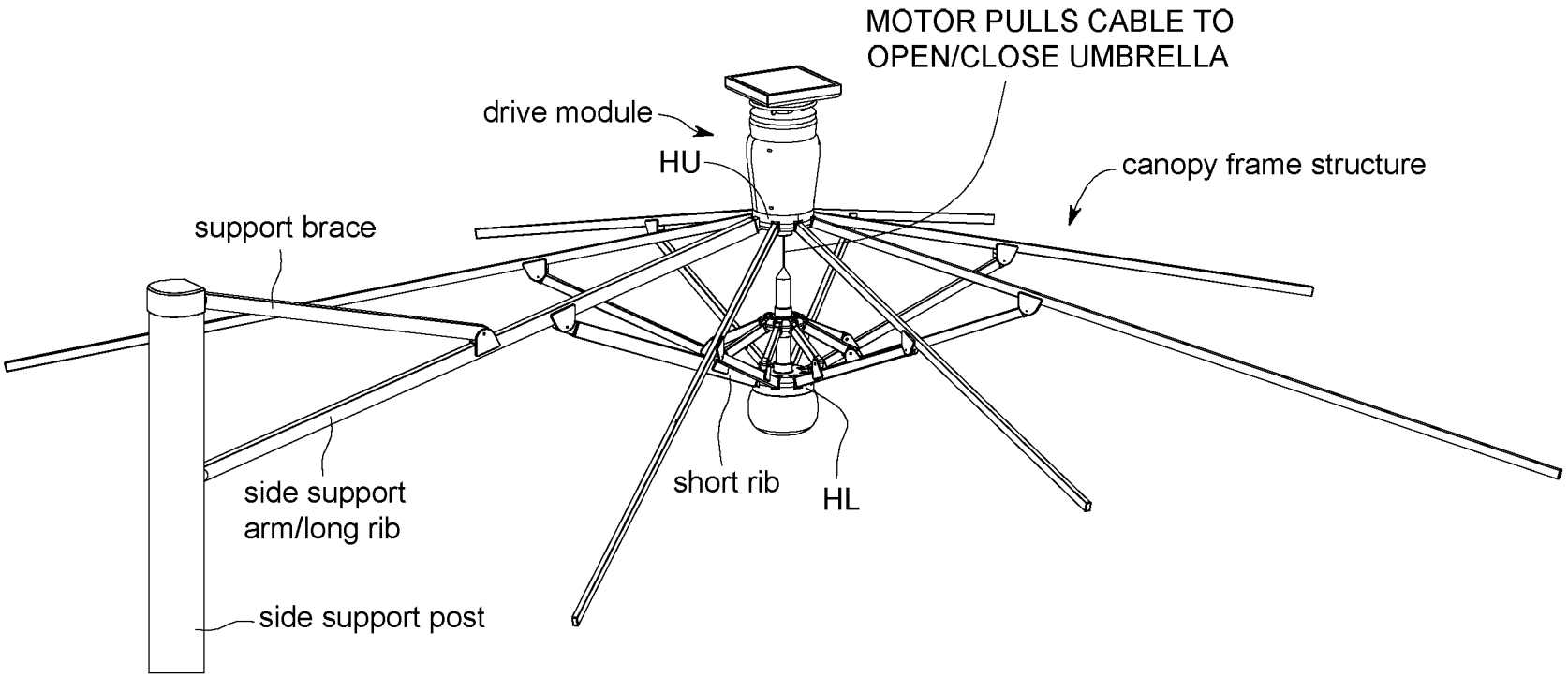
Figure 8D:
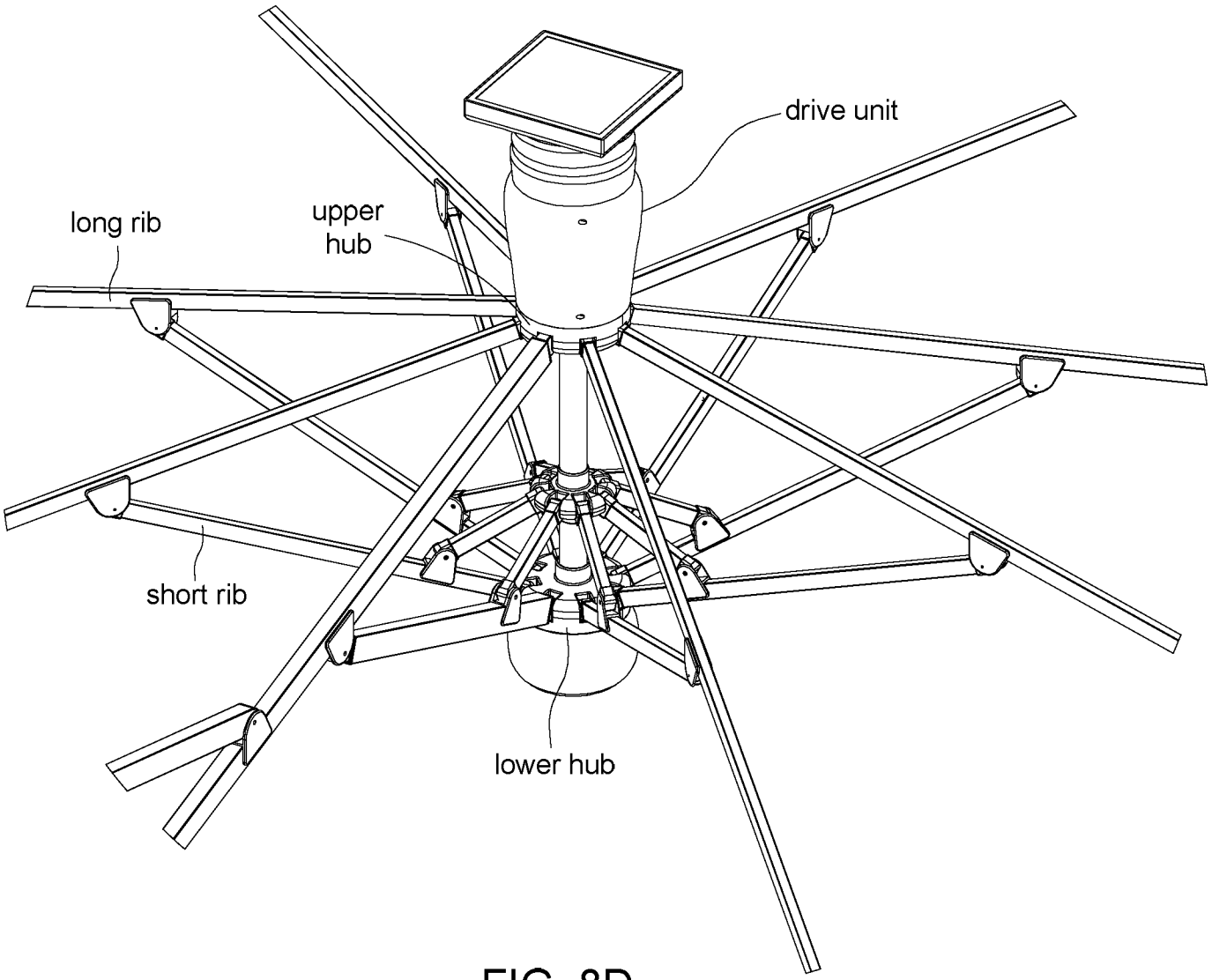
Figure 8E:
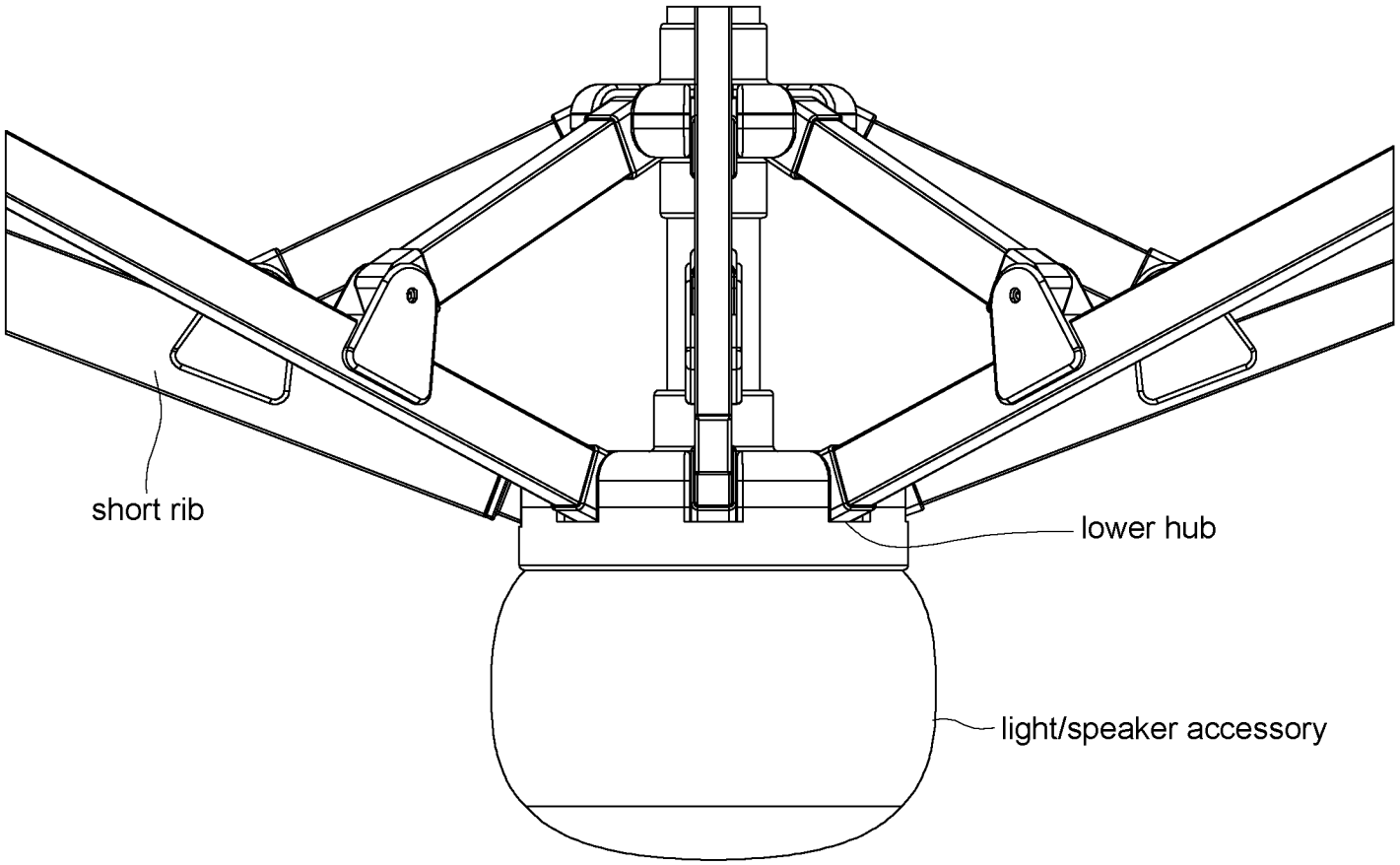

To facilitate ease of user control of the umbrella assembly U, the remote control RC may be removably/detachably attached to the umbrella assembly (e.g., on the post, as shown in FIGS. 7 and 8A, for example). In one embodiment, the remote control RC may be magnetically attached to the post, or by means of Velcro fasteners, snap fasteners, hook fasteners, pocket, docking slot, etc. In another embodiment, a docking base (e.g., a slot) may be provided along the post, which docking base/slot is sized to receive the remote control. The docking slot may have a depth that receives the remote control such that the remote control is flush against or close to the surface of the post, so as to blend in to appear as if the remote control is part of the exterior of the post. When the remote control is placed in the docking slot, a user can control the umbrella assembly by activating the buttons/switches on the remote control; to a casual viewer, the remote control appears to be a user control interface that is permanently provided in the post, even though it communicates wirelessly with the control unit.

In another embodiment, a wireless control could be made a permanent, non-detachable part of the post, so that wiring is not needed to communicate with the control unit in the drive unit. Further, in this embodiment, a separate wireless remote control may be additionally provided to facilitate a user to remotely and wireless control the drive module at a distance.

In another embodiment, if running wiring through the post is acceptable, at the post of the umbrella assembly, to provide a user easy access to operating the umbrella assembly, a user control module/panel (e.g., control buttons and switches) may be provided, which the user can use to control operation of the umbrella assembly (e.g., open, close, lighting on/off, etc.) Control wirings run within the post, from the drive module control panel.

In a further embodiment, both wireless and wired control of the control unit in the drive module may be provided.

By deploying a drive module complete with power supply unit and drive unit, and further with a control unit and sensor unit, there is reduced need to run electrical wires within the umbrella assembly (e.g., under the canopy) as was done in the prior art. Optional speaker, accent lighting, cooling fans, video displays, etc. may be provided under the canopy as add-on accessories to be powered by the power supply unit. See, also, FIGS. 3B, 4A, 4H, 6H, 7 and 8A. These add-on accessories do not require a high level of integration during assembly, or they could be finally assembled by a user before placing the umbrella into operation. These add-on accessories could draw required low voltage/current electrical power from the power supply unit via a common power supply cable running from the upper hub to the lower hub of the umbrella assembly.

Figure 5A:
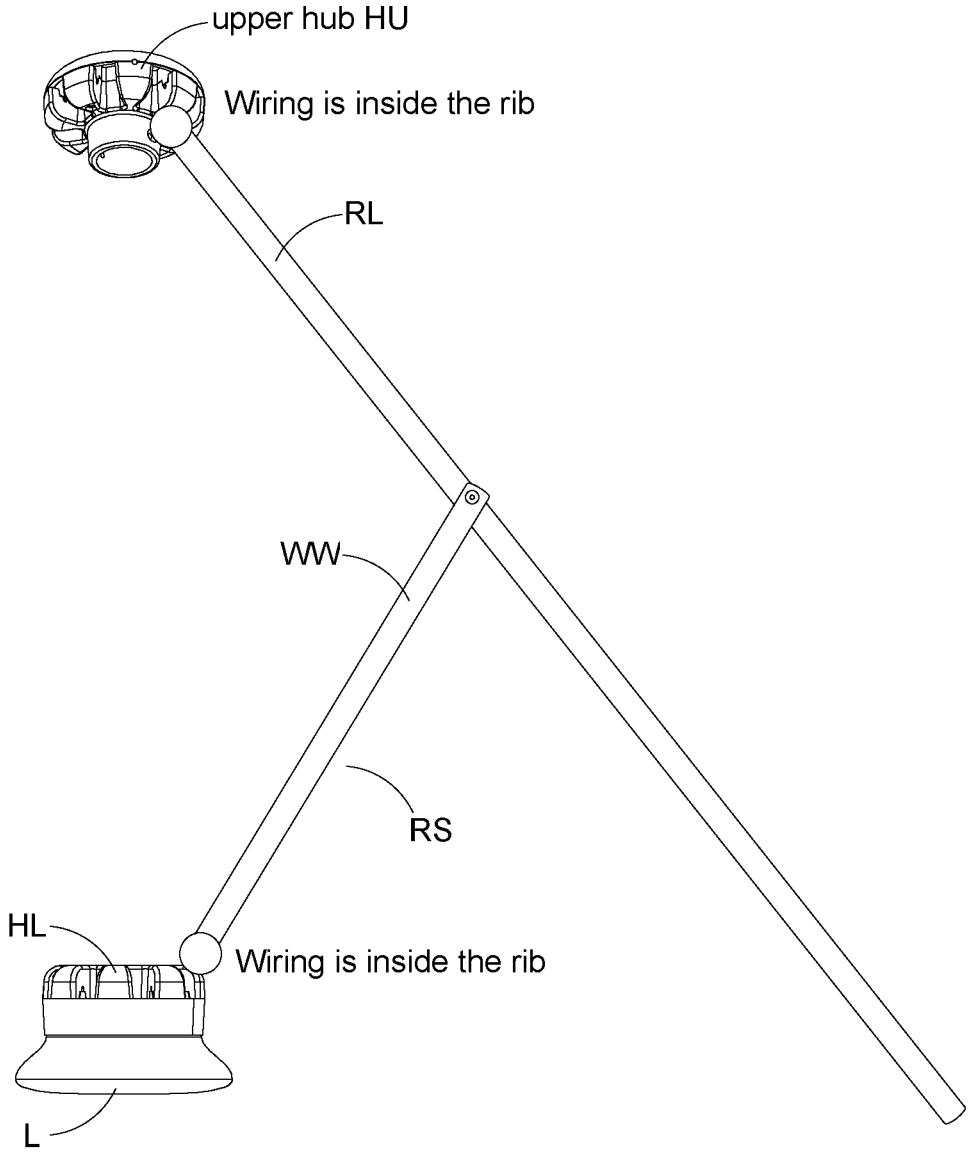
FIGS. 5A and 5B are perspective views of wiring between the upper hub and the lower hub through a long rib and corresponding short rib, in accordance with one embodiment of the present invention.
Figure 5B:
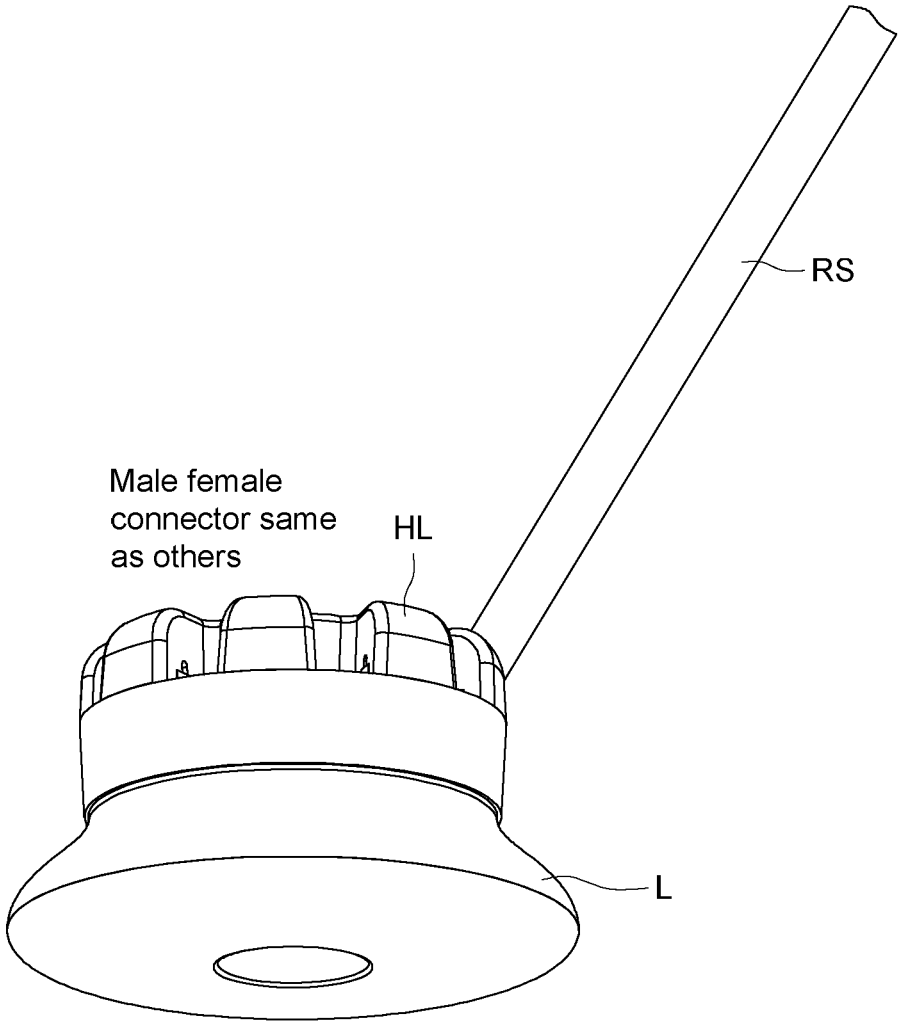
Figure 6A:
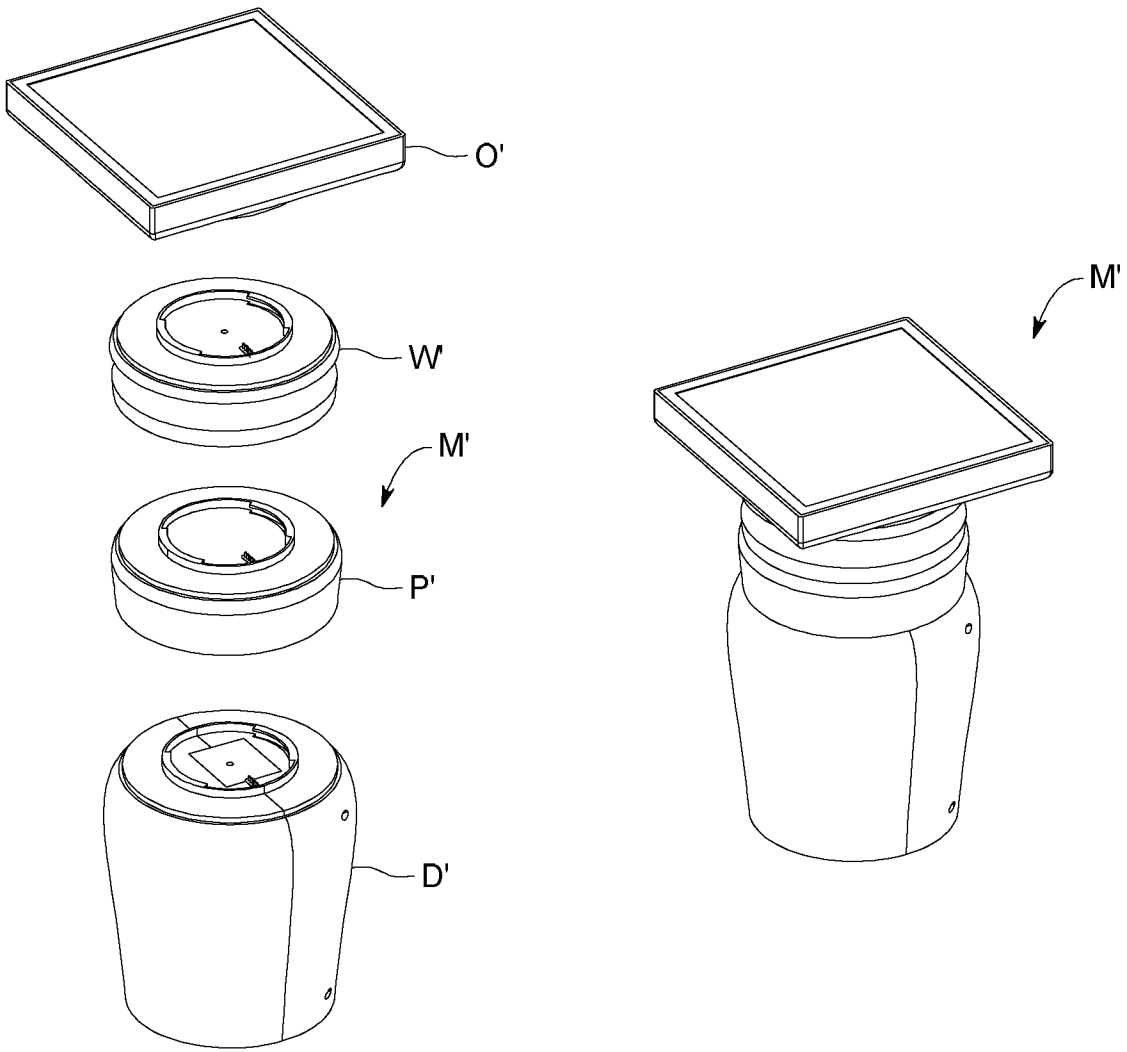
FIGS. 6A to 6H are perspective views of a drive module and modularized units thereof, in accordance with another embodiment of the present invention.
Figure 6B:
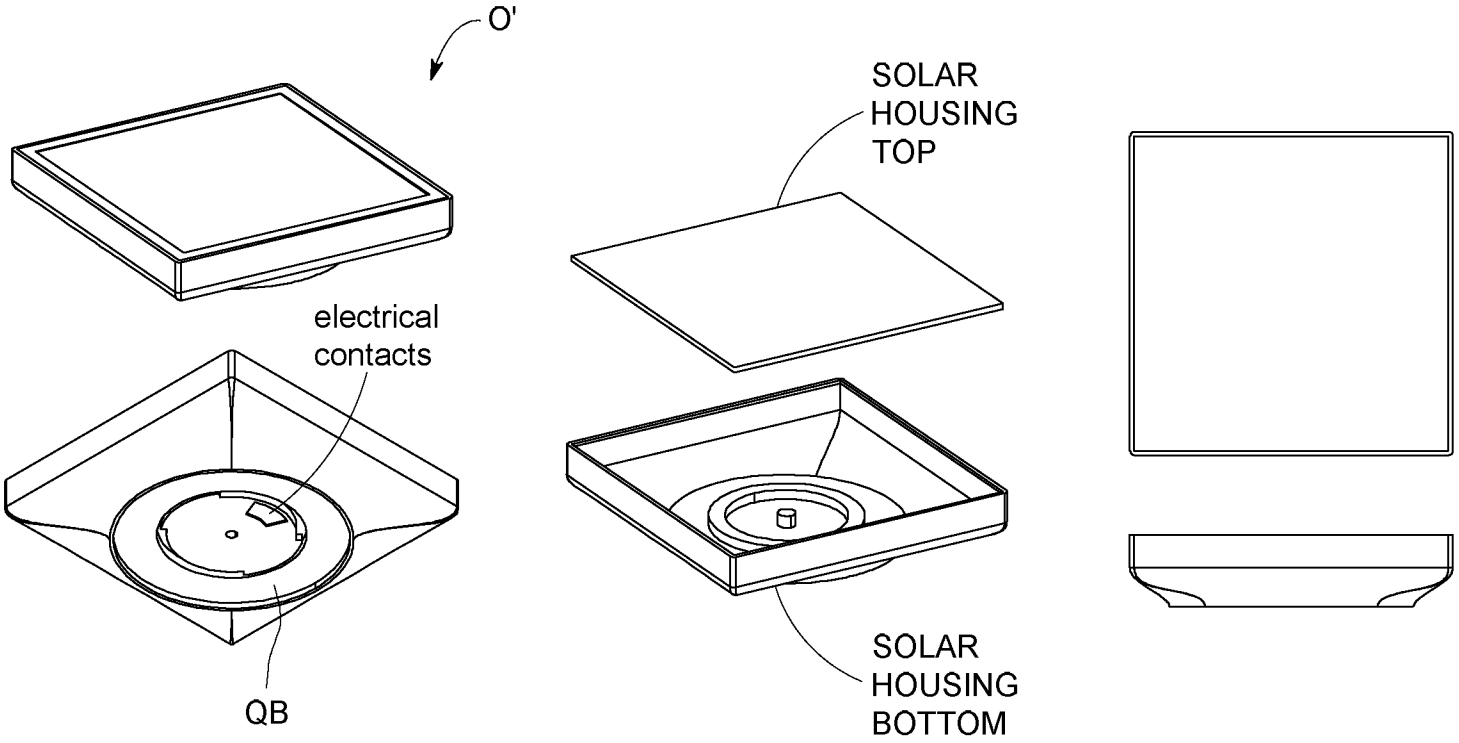
Figure 6C:
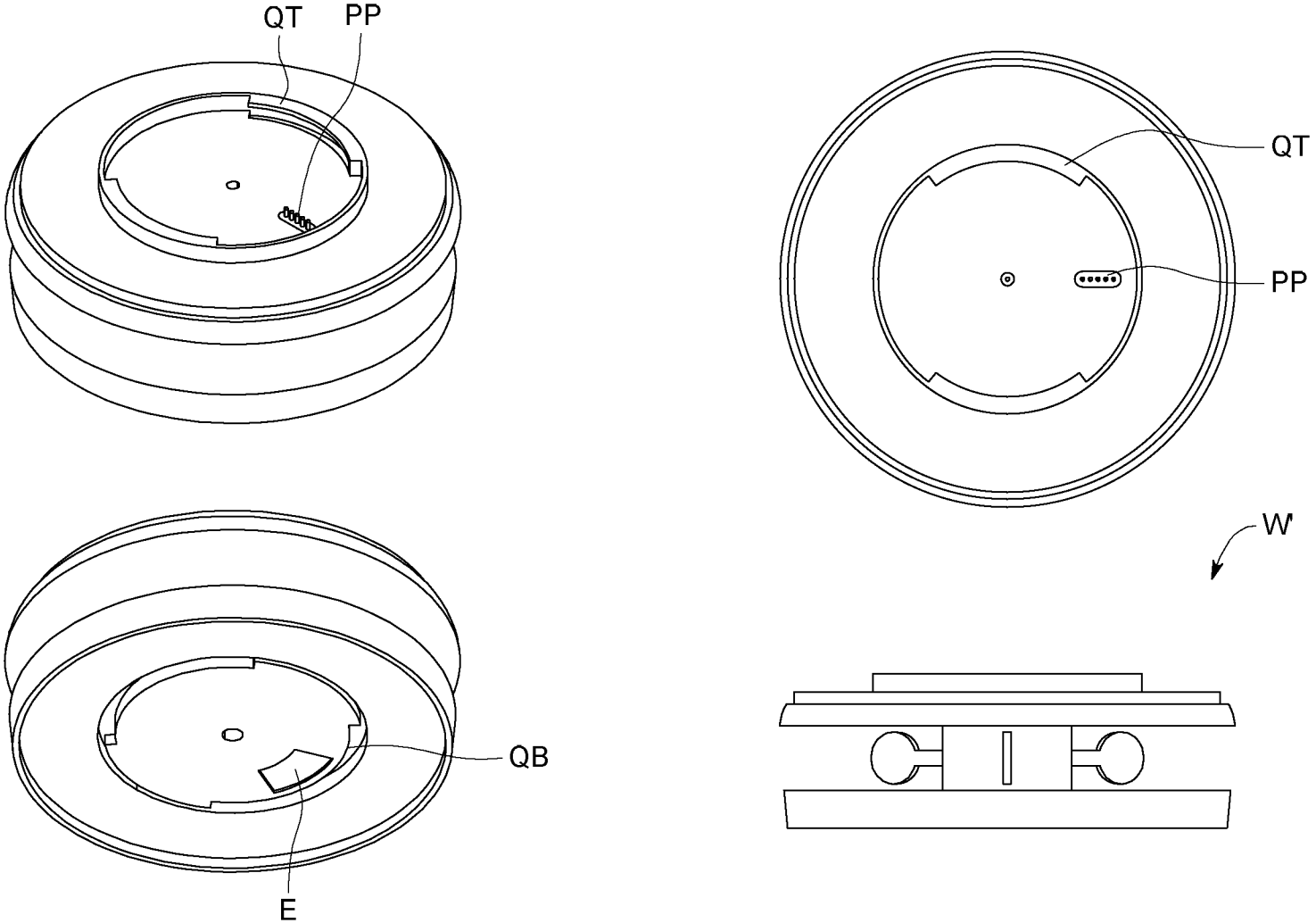
Figure 6D:
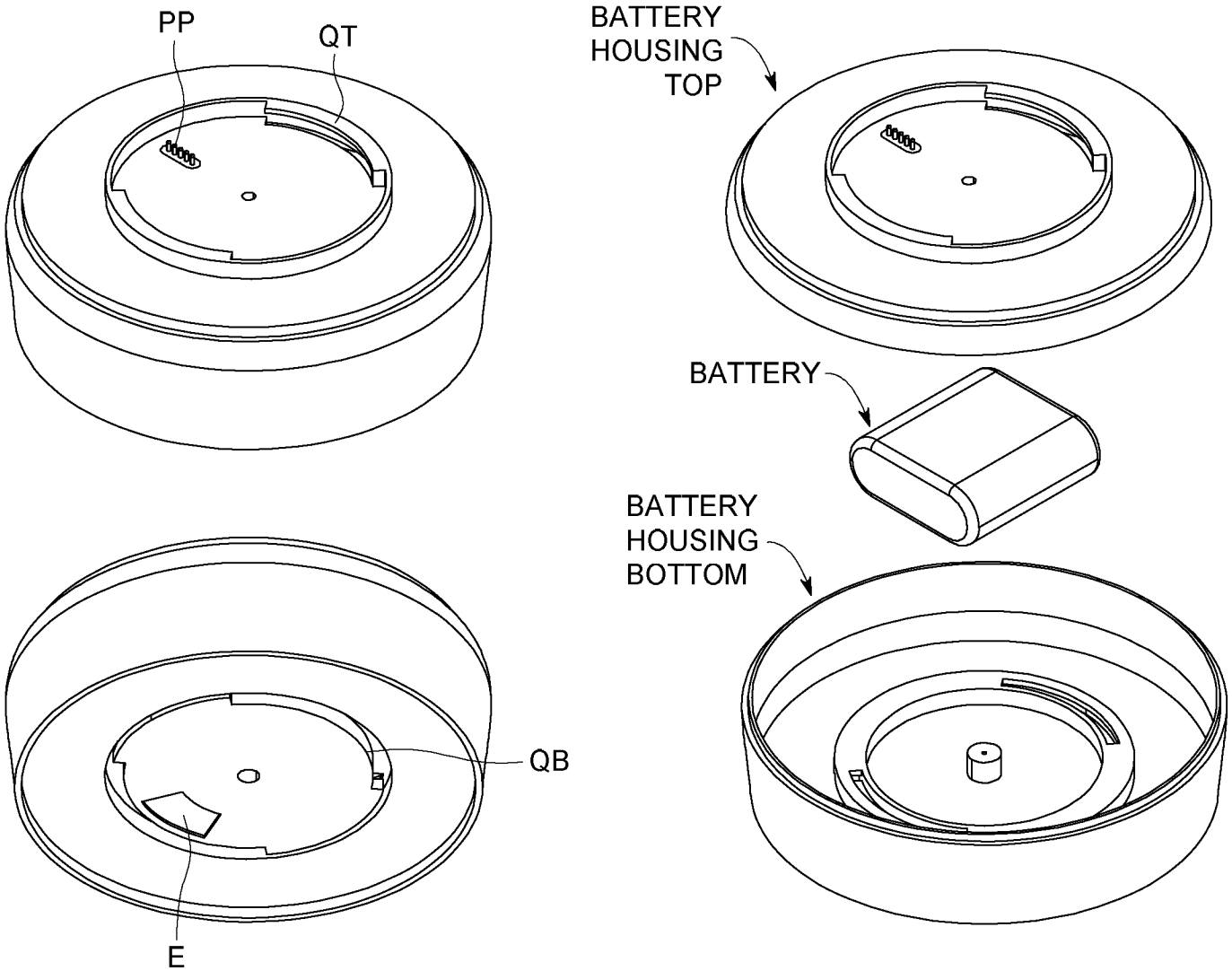
Figure 6E:
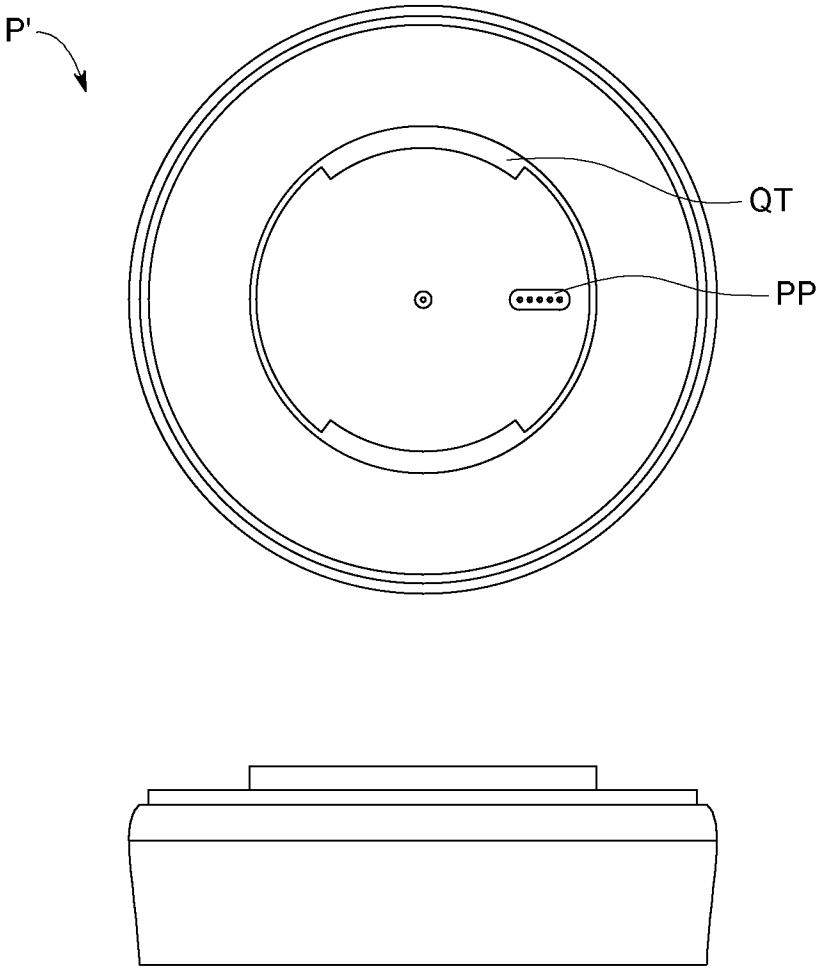
Figure 6F:
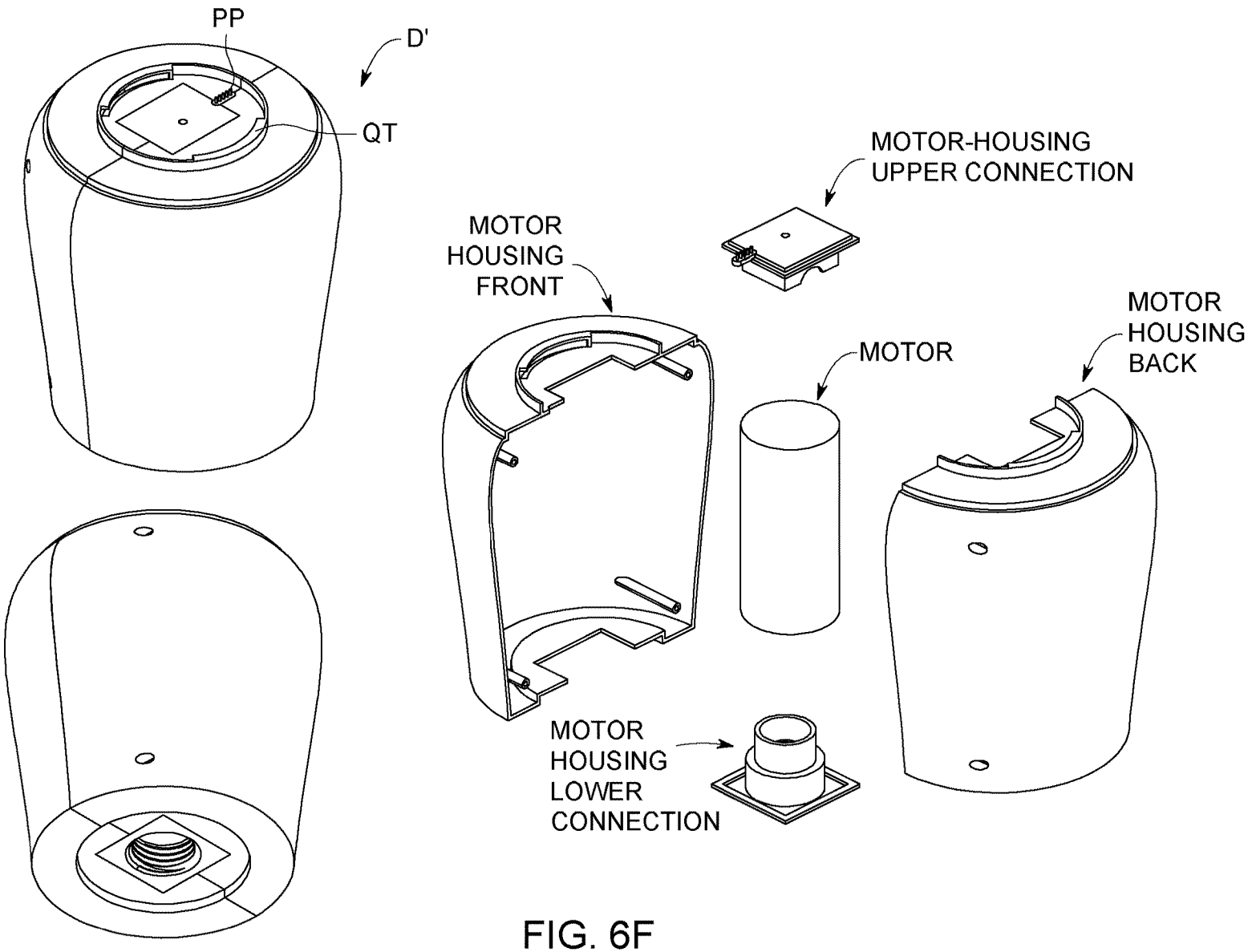
Figure 6G:
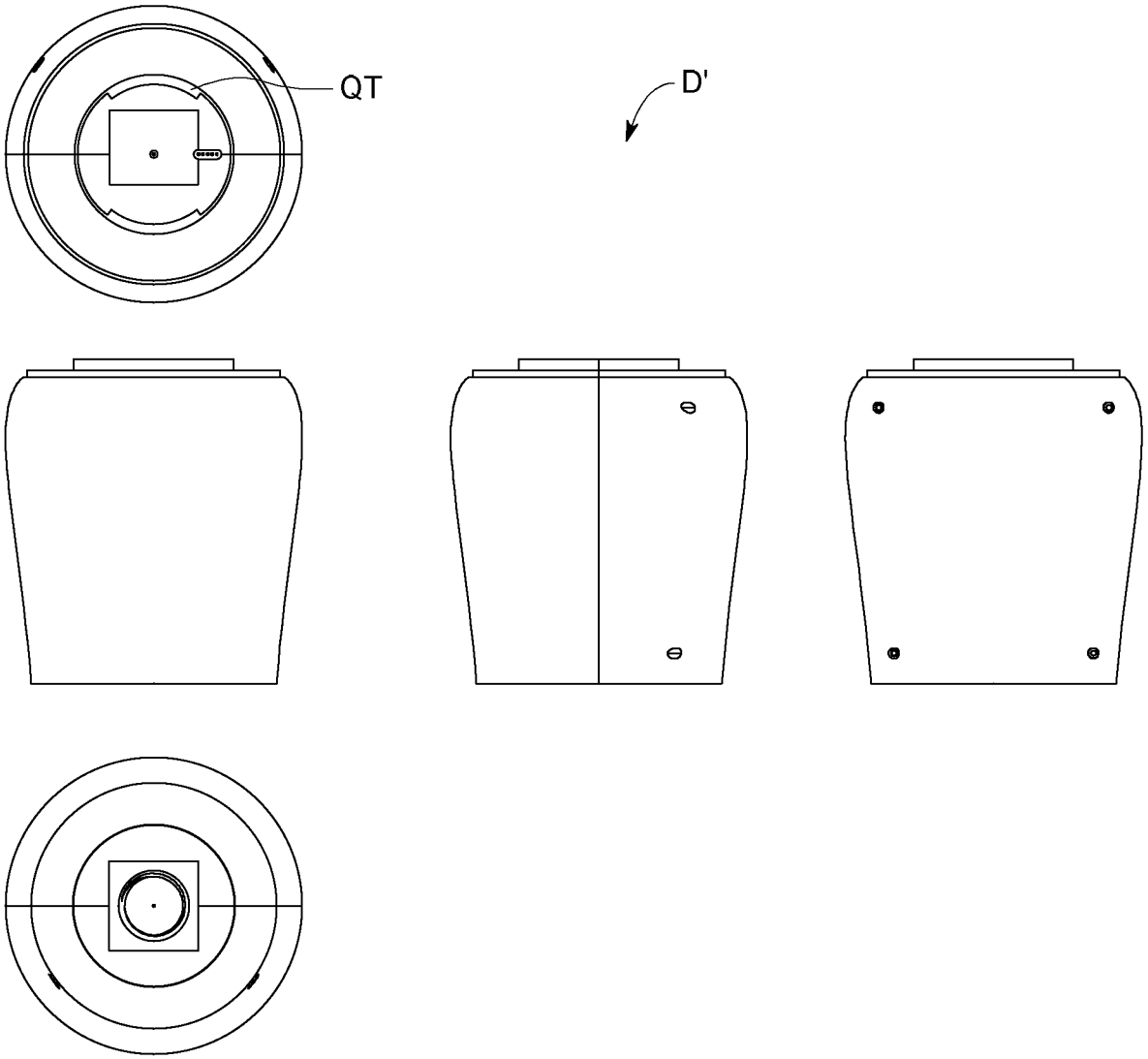
Figure 6H:
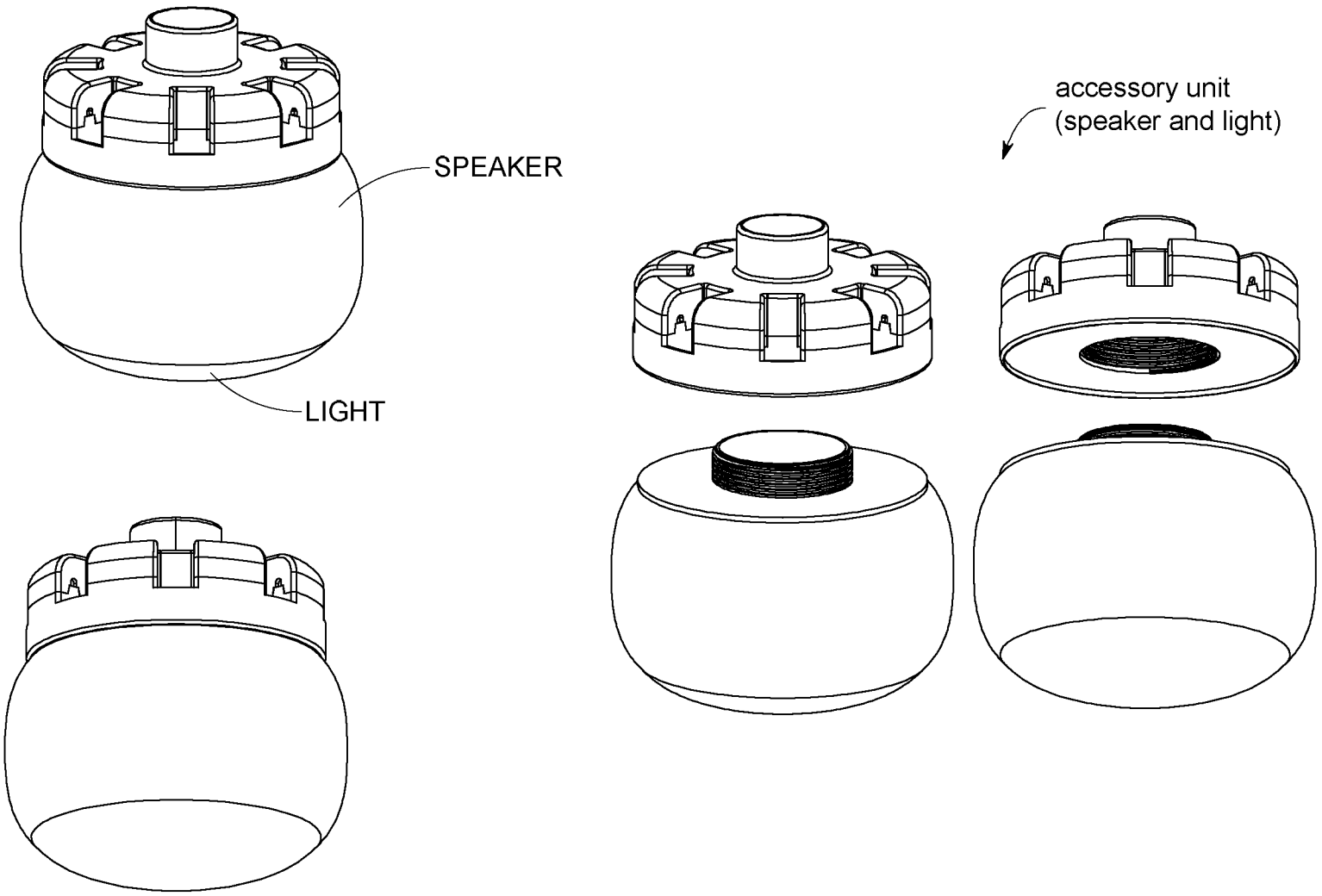

FIGS. 5A and 5B are perspective schematic views to illustrate wiring WW between the upper hub HU and the lower hub HL through a long rib RL and corresponding short rib RS, in accordance with one embodiment of the present invention. For example, as illustrated, a light unit L may be attached to the bottom of the lower hub HL. The light unit L, e.g., comprising LED lights, may be configured with a light diffusing housing in the shape of a donut having a central hole receiving the post. The bottom of the lower hub and the top of the light unit may be provided with complementary quick connect features (which could be similar to those for the modularized units in the drive module), so that the optional light unit can be easily coupled to the bottom of the lower hub of the umbrella assembly. Electrical power (e.g., low voltage DC) supplied to the light unit may be by way of wiring connectors (e.g., via wires running from the drive module (battery/power supply unit), through the upper hub, the long rib and the short rib, and the lower hub, to the light unit), as shown in FIGS. 5A and 5B.

FIGS. 6A to 6H are perspective views of a drive module M' and modularized units thereof for a motorized umbrella assembly U', in accordance with another embodiment of the present invention. The electrical contact terminals are more clearly shown in this embodiment. As illustrated, the complementary electrical contact terminals are in the form of spring loaded pogo pins PP and contact pads E on facing sides of adjacent modularized units. Otherwise, the structural features of this embodiment are similar in features and principle to the previous embodiment, with some changes to the housing and internal component configurations that do not deviate from the claimed invention herein.

By using modularized units to configure the drive module, they can be sourced from/provided by separate supplier(s)/manufacturer(s) that is/are separate from the suppliers/manufacturers of the collapsible umbrella assembly. To produce the umbrella assembly, the umbrella manufacturer who is familiar with production and assembly of relatively simple mechanical umbrella structure does not need to raise labor skill levels to otherwise integrate various electrical components and motorization components into the structure of the collapsible umbrella as was done in the prior art. The inventive smart umbrella could be shipped to customers with the drive module separate from the umbrella (in the same package or in separate packages), for easy final assembly by the user for use (stack coupling the modularized units and coupling to the top of the canopy. For example, the drive module can be easily coupled to the top of a central support post above the canopy in the case of a central supported umbrella assembly, or at the end of a cantilever arm above the canopy in the case of a side supported umbrella assembly. The center post may be made up of an upper post supporting the upper hub and lower hub.

Unlike the prior art in which the drive motor is installed below the canopy, e.g., about the middle of the center post, the inventive umbrella assembly allows for a more compact closure of the canopy about the post. Given there is no, or less wires, running below the canopy in the present invention, there is less chance for an open circuit from folding/collapsing of the frame structure in the inventive umbrella assembly.

The inventive drive module may be implemented/deployed in existing center post supported umbrellas, by retrofitting the drive module at the top end of the central support post. Depending on the configuration of a particular central supported umbrella assembly, some modifications may be required to attach the drive module onto the top end of the post, and to provide a cable connection between the pulley in the motor drive unit and the lower hub in the existing umbrella assembly (including creating a small opening for the cable to be threaded through). For certain existing umbrella assembly, the modifications required may be minimal for improved functionalities and features of the existing umbrella assembly.

It is understood that the scope and spirit of the present invention is not limited to the specific removable/detachable coupling/attachment of the various modularized units. Other types of removable/detachable coupling of the modularized units in the drive module not specifically disclosed and illustrated herein may be implemented without departing from the scope and spirit of the present invention.

In an exemplary embodiment, the drive housing and the power supply housing may be removably/detachably coupled by a threaded interface between the bottom of the power supply housing and the top of the drive housing. The power supply housing may be screwed onto/off the drive housing.

In a further exemplary embodiment, the drive housing and the power supply housing may be removably/detachably coupled by using one or more fasteners (e.g., screws, bolts, snaps, inserts, tabs, twist knobs, keys, straps, and the like) that permits the user to easily undo the fasteners to allow the drive housing and the power supply housing to be coupled/attached after the bottom of the power supply housing rested on the top of the drive housing and decoupled/separated, for example, without using handtools, or with minimal use of handtools, or without having to use specialized tools.

The control unit and/or the power supply/storage unit in the drive module M and M" (and also in the drive module M" in the further embodiment discussed below) discuss herein may include a battery power management feature, to regulate the use of stored power to reserve power needed to close the umbrella assembly in the event of undesirable wind conditions (or open the umbrella in the event of rain). The power regulating function may regulate to reserve/dedicate, e.g., at least 20% electrical/battery power remaining to operate the umbrella assembly, or sufficient remaining electrical power for a user predetermined number of opening/closing of the umbrella assembly. An alarm may be provided, or an alert on the user electronic device if an application was installed, if the remaining electrical/battery power reached the predetermined threshold level. Accordingly, if the light unit consumed battery power or the umbrella had been operated but there was not sufficient sunlight for the solar panel to generate enough charges to recharge the battery/power storage unit, there will always be some battery power remaining for limited operation of the umbrella assembly. Furthermore, the battery power management may include regulating how much power is supplied to the light module or any other battery consuming functions other than opening/closing of the umbrella assembly. For example, the battery power management feature may include providing power to lit the LEDs in the light unit at 100% brightness for a predetermined number of hours (e.g., 3 hours), but dim the LEDs to 50% brightness for rest of time they are kept on, until there is 20% battery power remaining.

EXEMPLARY SPECIFICATION FOR SMART UMBRELLA

1. General Specifications:
   - 1.1 ARM Cortex MO core microcontroller (MCU).
   - 1.2 Three-leaf cup wind speed Hall Sensor detection component.
   - 1.3 Polycrystalline silicon solar panels.
   - 1.4 6000 mAh high-capacity lithium-ion power battery for power storage.
   - 1.5 High-efficiency 2 W dimmable LED lighting.
   - 1.6 Remote control to close/open the umbrella, and light on and off.
   - 1.7 The umbrella will automatically close in the strong wind. LED>6H automatically turns off.
   - 1.8 Buzzer working status prompt
2. Solar Panel Specifications:
   - 2.1 Size: 150 mm*125 mm*3.5 mm
   - 2.2 Material: Polysilicon
   - 2.3 Conversion efficiency: 18.6%
   - 2.4 Working voltage (Vmp): 5V±5%
   - 2.5 Working current (Imp): 480 mA±5%
   - 2.6 Open circuit voltage (Voc): 6.1V±5%
   - 2.7 Short circuit current (Isc): 500 mA±5%
   - 2.8 Lifespan: 3 years
   - 2.9 Working conditions: −20° C. TO 60° C.
3. Lithium Battery Specifications:
   - 3.1 Typical Capacity: 6000 mAh
   - 3.2 Minimum capacity: 5850 mAh
   - 3.3 Full charging time: ~13H (depending on the intensity of sunlight and the use of the device during charging).
   - 3.4 Nominal voltage: 3.7V 3.5 Max continuous discharge current: 5000 mA
3.6 Battery size: 69.0×55.5×21 mm MAX
3.7 Life: 300 cycles 4. LED Lighting Specifications:
4.1 Power: 2 W
4.2 Brightness: 200 LM MAX
4.3 color temperature; 4500K
4.4 Switch mode: On/off: remote control lighting button Auto: Remote control on 3H: 100% brightness, 3-6H: 50% brightness, >6H off
4.5 Maximum battery life: >9H (maximum brightness/full power)
4.6 Turn off the lights when the battery power is less than 25%.
4.7 Close the umbrella and turn off the lights.

5. Remote Control Specifications:
5.1 Remote control frequency: 433.92 MHz
5.2 Remote control distance: 50 meters
5.3 Button: UP/DOWN/lighting
5.4 Automatic code pairing when power on 6. Motor Specifications:
6.1 Rated voltage: 12V
6.2 Load current: 1.6 A
6.3 moment; 20 kg·cm
6.4 Battery life: 300 times (open/close/full power)

7. Three-Leaf Cup Wind Speed Sensor with Hall Sensor Detection Component Specifications:
7.1 Sensor: Hall
7.2 Gear DIP switch (built-in motherboard): 1st gear: 18 mph; 2nd gear: 20 mph. 3rd gear: 22 mph 8. Warning Buzzer Specification
8.1 Remote control button beep sound.
8.2 The buzzer for automatic umbrella closing will beep until the umbrella is closed.
8.3 When the battery is powered on, it will beep for 200 milliseconds.
8.4 Low battery beeps twice for 200 ms.

While the invention has been discussed above primarily in reference to a central support umbrella assembly, the inventive concept of the same drive module can be deployed for cantilevered/side supported umbrella assemblies, without departing from the scope and spirit of the present invention. FIGS. 8A to 8E are perspective views of deployment of a drive module M' for a side post supported cantilevered umbrella assembly U", in accordance with another embodiment of the present invention. The drive module U' illustrated in FIGS. 6A to 6H is deployed in this embodiment, in a similar fashion in the earlier embodiments, with the exception of the configuration of the support of the support frame of the canopy assembly. In this embodiment, the canopy support frame F' is supported by a side support post PS in a cantilevered fashion. A side support arm AS is cantilevered and extends from the side support post PS, wherein an extended end of the side support arm AS supports the upper hub HU of the frame structure F', and wherein the frame structure F' of the canopy C is on one side of the side support post PS. In the illustrated embodiment, a distal end of the side support arm AS is slidably coupled to the side support post PS via a roller assembly RO and complementary track(s) TR along the vertical side of the side support post PS. As illustrated, the support structure further comprises a support brace BS having one end PA pivotally attached to the top of the side support post PS and another end pivotally attached to a location PR along the side support arm. Further in this embodiment, the side support arm AS is taken as one of the long ribs RL in the frame structure F' of the canopy C. As in the previous embodiments, the canopy frame structure F' has long ribs RL having one end pivotally coupled to the upper hub HU and short ribs RS pivotally coupled to the corresponding long ribs RL and the lower hub HL. The side support arm AS, the side support brace BS, the corresponding long rib RL and the corresponding short rib RS together form a 'scissor' of 'X' like pivotal structure to facilitate the side support arm distal end having the roller assembly RO to slide up and down the side support post PS when the frame structure F' of the canopy opens and closes, respectively. As was in the previous embodiment, the drive unit D' in the drive module M' deploys a cable A (e.g., using a pulley to wind/unwind the cable) to pull up or lower down the lower hub HL to open/close the umbrella canopy frame structure F'.

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. A motorized umbrella assembly, comprising:
a support structure;
a canopy comprising:
a frame structure supported by the support structure, and
a flexible canopy material supported on the frame structure; and
a centralized drive module comprising a plurality of modularized units each having a separate housing configured to be removably/detachably stacked into a stacked structure of the overall drive module, wherein the housings of adjacent modularized units in the stack structure are removably/detachably attached to one another with a bottom side of one modularized unit removably/detachably attached to a top side of another modularized unit in the stacked structure, thereby one or more modularized units may be optionally omitted from or added to the stacked structure to form the overall drive module, and wherein the drive module is structurally and operatively coupled to the frame structure to operate to open/extend or close/collapse the canopy between an opened configuration and a closed configuration,
wherein the modularized units of the drive module comprise:
a modularized drive unit comprising a drive motor and associated drive transmissions; and
a modularized power supply unit removably/detachably attached to the drive unit,
wherein the power supply unit supplies electrical power to the drive module.

2. The motorized umbrella assembly as in claim 1, wherein the modularized units are configured to be removably/detachably stacked into the stacked structure of the overall drive module using quick connect couplings provided on the respective housings comprising complementary quick connect features provided at the top and bottom sides of respective housings of the modularized units to facilitate quick connect couplings of adjacent modularized units without requiring using handtools or with minimal use of handtools, thereby facilitating quick removably/detachably coupling between the bottom side of one modularized unit to the top side of another modularized unit, to facilitate configuring a stack of modularized units removably/detachably attached to form the overall drive module, and wherein the interfacing top and bottom sides of the adjacent modularized units are provided with complementary electrical connection terminals.

3. The motorized umbrella assembly as in claim 2, wherein the quick connect features comprises complementary features at the top and bottom sides of the respective housings of the modularized units to facilitate quick connect mating or turn couplings of adjacent modularized units.

4. The motorized umbrella assembly as in claim 3, wherein the quick connect features at the top and bottom sides of the respective housings of the modularized units are similar to facilitate interchangeability of the modularized units for stacking in a desired order of the modularized units in the stacked structure.

5. The motorized umbrella assembly as in claim 1, wherein the power supply unit has a power supply housing having a top side and a bottom side and the drive unit has a drive housing having a top side and a bottom side, and wherein the bottom side of the power supply housing is configured to be removably/detachably attached to the top side of the drive housing, and wherein the interfacing surfaces of the top side of the drive housing and the bottom side of the power supply housing have complementary electrical connection terminals.

6. The motorized umbrella assembly as in claim 5, wherein the drive unit or the power supply unit comprises a control unit.

7. The motorized umbrella assembly as in claim 1, wherein the frame structure comprises:

a support hub assembly having an upper hub and a lower hub below the upper hub, wherein the upper hub is connected to the support structure;

a plurality of longitudinal long ribs, wherein each long rib has an end removably coupled to the upper hub at an upper end of the support hub assembly;

a plurality of longitudinal short ribs, each comprising a first end pivotally coupled to a location along a corresponding long rib and a second end removably coupled to the lower hub at a lower end of the support hub assembly, wherein the canopy material is supported on the long ribs, spanning over the long ribs, wherein the drive module operates to open/extend or close/collapse the frame structure of the canopy between the opened configuration and the closed configuration by varying the distance between the upper hub and the lower hub to pivot the short rib relative to the long rib, whereby the canopy is closed/collapsed when the lower bub is lowered away from the upper hub, and the canopy is opened/extended when the lower hub is raised towards the upper hub, wherein the drive motor is operatively coupled to the lower hub via a pulley and a cable that runs through a hole provided in the upper hub and having a distal end connected to the lower hub, wherein the drive motor is operated to wind the cable onto the pulley to raise the lower hub towards the upper hub to open the frame structure of the canopy, and to unwind the cable from the pulley to lower the lower hub away from the upper hub to close the frame structure of the canopy, and wherein the lower hub is lowered under the weight of the collapsible frame structure of the umbrella assembly as tension in the cable is released by unwinding from the pulley as driven by the drive motor.

8. The motorized umbrella assembly as in claim 7, wherein the top side of the upper hub is provided with quick coupling features, whereby the quick coupling features at the bottom of the motor drive unit matches the quick coupling features at the top side of the upper hub to facilitate quick coupling of the bottom side of the stacked drive module to the top side of the upper hub of the frame structure of the canopy.

9. The motorized umbrella assembly as in claim 1, wherein the modularized units of the drive module further comprise a modularized sensor unit removably/detachably attached to the power supply unit, wherein the sensor unit has a bottom side that is configured to be removably/detachably attached to the top of the power supply housing.

10. The motorized umbrella assembly as in claim 9, wherein the sensor unit comprises at least one of a wind sensor, atmospheric pressure sensor, temperature sensor, tilt sensor, motion sensor, oscillation sensor, and wherein separate sensors or combination of sensors are embodied in separate modularized units, thereby a user can customize the configuration of the umbrella assembly with desired sensors.

11. The motorized umbrella assembly as in claim 1, wherein the frame structure comprises:

a support hub assembly having an upper hub and a lower hub below the upper hub, wherein the upper hub is connected to the support structure;

a plurality of longitudinal long ribs, wherein each long rib has an end removably coupled to the upper hub at an upper end of the support hub assembly;

a plurality of longitudinal short ribs, each comprising a first end pivotally coupled to a location along a corresponding long rib and a second end removably coupled to the lower hub at a lower end of the support hub assembly, wherein the canopy material is supported on the long ribs, spanning over the long ribs, and wherein the support structure comprises one of:

(a) a central support post extending through the lower hub and having an upper distal end supporting the upper hub of the frame structure, and wherein the long ribs and short ribs of the frame structure extends away from the central post in the opened configuration, and (b) a side support post and a side support arm cantilevered and extending from the side support post, wherein an extended end of the side support arm supports the upper hub of the frame structure, and wherein the frame structure is on one side of the side support post, wherein a distal end of the side support arm is slidably coupled to the side support post to facilitate the distal end to slide up and down the side support post when the frame structure of the canopy opens and closes, respectively, wherein the support structure further comprises a support brace having one end pivotally attached to the top of the side support post and another end pivotally attached to a location along the side support arm.

12. A motorized umbrella assembly, comprising:

a support structure;

a canopy comprising:

a frame structure supported by the support structure, and a flexible canopy material supported on the frame structure; and a centralized drive module comprising a plurality of modularized units each having a separate housing configured to be removably/detachably stacked into a stacked structure of the overall drive module, wherein the housings of adjacent modularized units in the stack structure are removably/detachably attached to one another with a bottom side of one modularized unit removably/detachably attached to a top side of another modularized unit in the stacked structure, thereby one or more modularized units may be optionally omitted from or added to the stacked structure to form the overall drive module, and wherein the drive module is structurally and operatively coupled to the frame structure to operate to open/extend or close/collapse the canopy between an opened configuration and a closed configuration, wherein the modularized units further comprise a modularized solar panel unit removably/detachably attached to the top side of the sensor unit or the power supply unit, wherein the solar panel unit includes a solar panel and a casing that has a bottom side provided with quick connect features to the adjacent modularized unit.

13. A modularized drive assembly for an umbrella assembly, comprising:

a plurality of modularized units, each having a separate housing configured to be removably/detachably stacked into a stacked structure of the overall drive assembly, wherein the housings of adjacent modularized units in the stack structure are removably/detachably attached to one another with a bottom side of one modularized unit removably/detachably attached to a top side of another modularized unit in the stacked structure, thereby one or more modularized units may be optionally omitted from or added to the stacked structure to form the overall drive assembly, wherein the plurality of modularized units includes:

a drive unit which comprises a drive motor and associated drive transmissions; and a power supply unit removably/detachably attached to drive unit wherein the power supply unit supplies electrical power to the drive module, and wherein the drive unit is structurally and operatively coupled to a frame structure of a canopy of the umbrella assembly to operate to open/extend or close/collapse the canopy between an opened configuration and a closed configuration.

14. The modularized drive assembly as in claim 13, wherein the modularized units are configured to be removably/detachably stacked into a stacked structure of the overall drive module using quick connect couplings, thereby facilitating quick removably/detachably coupling between the bottom side of one modularized unit to the top side of another modularized unit, to facilitate configuring a stack of modularized units removably/detachably attached to form the overall drive module, and wherein the interfacing top and bottom sides of the adjacent modularized units are provided with complementary electrical connection terminals.

15. The modularized drive assembly as in claim 14, wherein the modularized units are provided with quick connect features at the top and bottom sides of respective housings of the modularized units to facilitate quick connect couplings of adjacent modularized units.

16. The modularized drive assembly as in claim 15, wherein the quick connect features at the top and bottom sides of the respective housings of the modularized units are similar to facilitate interchangeability of the modularized units for stacking in a desired order of the modularized units in the stacked structure.

17. The modularized drive assembly as in claim 16, wherein the interfacing surfaces of the top side of the drive housing and the bottom side of the power supply housing have complementary electrical connection terminals.

18. The modularized drive assembly as in claim 13, wherein the modularized units further comprise a modularized sensor unit removably/detachably attached to the power supply unit, wherein the sensor unit has a bottom side that is configured to be removably/detachably attached to the top of the power supply housing.

19. The modularized drive assembly as in claim 13, wherein the modularized units further comprise a modularized solar panel unit removably/detachably attached to the top side of the sensor unit or the power supply unit, wherein the solar panel unit includes a solar panel and a casing that has a bottom side provided with quick connect features to the adjacent modularized unit.

* * * * *